US005686885A

United States Patent [19]

Bergman

[11] Patent Number: 5,686,885

[45] Date of Patent: Nov. 11, 1997

[54] SENSOR TEST METHOD AND APPARATUS

[75] Inventor: John Bergman, Ham Lake, Minn.

[73] Assignee: Interactive Technologies, Inc., North St. Paul, Minn.

[21] Appl. No.: 535,707

[22] Filed: Sep. 28, 1995

[51] Int. Cl.[6] ..... G08B 29/00

[52] U.S. Cl. ..... 340/514; 340/506; 340/515; 340/539; 340/531; 340/825.69; 340/825.72

[58] Field of Search ..... 340/505, 506, 340/514, 515, 825.54, 531, 528, 539, 532, 534, 828.46, 828.69, 828.72, 628–630

[56] References Cited

U.S. PATENT DOCUMENTS

| | | | |
|---|---|---|---|
| 4,044,351 | 8/1977 | Everson | 340/514 |
| 4,206,450 | 6/1980 | Harden et al. | 340/515 |
| 4,412,211 | 10/1983 | Lautzenheiser et al. | 340/514 |
| 4,884,059 | 11/1989 | Shapiro | 340/514 |
| 4,901,056 | 2/1990 | Bellavia et al. | 340/514 |
| 4,908,602 | 3/1990 | Reich et al. | 340/514 |

*Primary Examiner*—Jeffery Hofsass
*Assistant Examiner*—Daryl C. Pope
*Attorney, Agent, or Firm*—Fish & Richardson P.C.

[57] ABSTRACT

In a security system having a remote monitoring station, a sensor is tested when the security system is in a normal operating mode. The sensor is tested by actuation of a button on the sensor. Actuation of the button generates a signal indicating that a test has been conducted. Upon the generation of both an alarm signal generated by the test and a signal indicating that a test has been conducted, the security system determines that the alarm signal was generated by a test of the sensor and not by the detection of alarm conditions by the sensor.

19 Claims, 15 Drawing Sheets

*Fig. 6*

| TYPE OF DETECTION (126) | ALARM SIGNAL | SAMPLED ALARM SIGNAL (254) | PRE-ALARM SIGNAL (124) | OUTPUT OF DISABLING CIRCUIT 128 (258) | PREALARM SAMPLED SIGNAL (252) | TEST SIGNAL (250) | SAMPLE TEST BUTTON SIGNAL (256) |
|---|---|---|---|---|---|---|---|
| SMOKE | HIGH | HIGH | HIGH | LOW | LOW | LOW | LOW |
| DUST | LOW | LOW | HIGH | HIGH | HIGH | HIGH | LOW |
| TEST BUTTON ACTIVATED | HIGH | HIGH | HIGH | LOW | LOW | HIGH | HIGH |

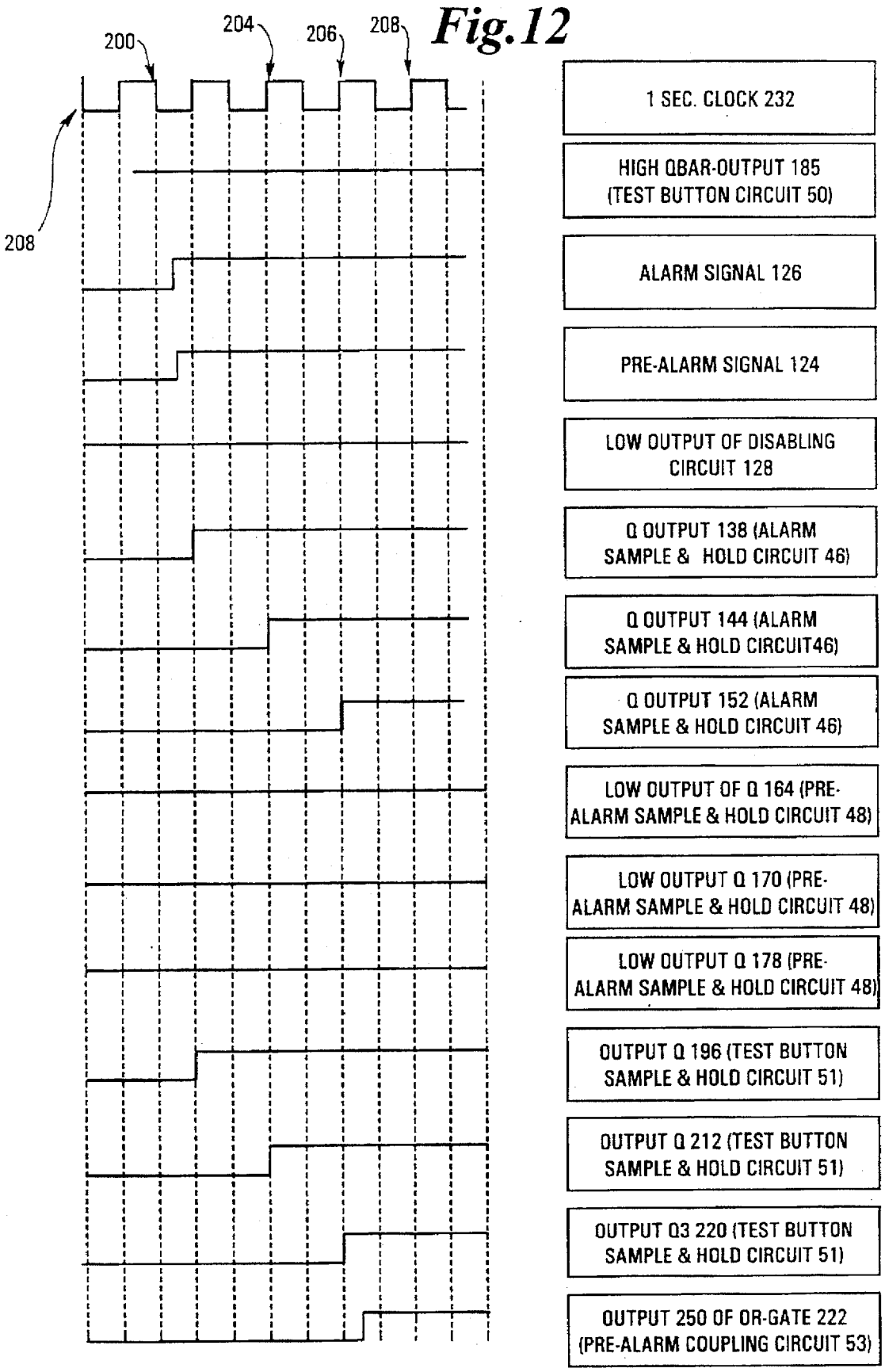
Fig.12
200
204
206
208
208
1 SEC. CLOCK 232
HIGH QBAR-OUTPUT 185 (TEST BUTTON CIRCUIT 50)
ALARM SIGNAL 126
PRE-ALARM SIGNAL 124
LOW OUTPUT OF DISABLING CIRCUIT 128
Q OUTPUT 138 (ALARM SAMPLE & HOLD CIRCUIT 46)
Q OUTPUT 144 (ALARM SAMPLE & HOLD CIRCUIT46)
Q OUTPUT 152 (ALARM SAMPLE & HOLD CIRCUIT 46)
LOW OUTPUT OF Q 164 (PRE-ALARM SAMPLE & HOLD CIRCUIT 48)
LOW OUTPUT Q 170 (PRE-ALARM SAMPLE & HOLD CIRCUIT 48)
LOW OUTPUT Q 178 (PRE-ALARM SAMPLE & HOLD CIRCUIT 48)
OUTPUT Q 196 (TEST BUTTON SAMPLE & HOLD CIRCUIT 51)
OUTPUT Q 212 (TEST BUTTON SAMPLE & HOLD CIRCUIT 51)
OUTPUT Q3 220 (TEST BUTTON SAMPLE & HOLD CIRCUIT 51)
OUTPUT 250 OF OR-GATE 222 (PRE-ALARM COUPLING CIRCUIT 53)

SENSOR TEST METHOD AND APPARATUS

BACKGROUND

Security systems are known for providing a reliable means for placing a call to a central station and for sounding a local siren in the event of an emergency condition. These security systems are used in homes and businesses. Security systems have a variety of sensors for detecting and reporting various conditions. A smoke sensor may be one part of a security system.

The present invention deals with two aspects of smoke detectors used in security systems: low battery condition reporting and test activation.

A. Low-Battery Reporting

Smoke sensors used in security systems are often battery operated. An underpowered battery could impair the operation of the smoke sensor, and a dead battery would make the smoke detector inoperable. One prior art solution to this problem is to provide a monitoring circuit which will produce an audible signal (e.g., a chirping sound) when the smoke sensor develops a low battery condition. Such circuits will faithfully generate an audible signal whenever the capacity of the battery is unacceptable, and those circuits will continually generate the audible signal until the battery is replaced or until its energy output becomes insufficient to power the battery monitoring circuit.

There are two disadvantages to the prior art technique of providing notice of a low battery condition in a smoke sensor to a user through such monitoring circuits—the type of notice being given and the timing of the notice. First, as to the type of notice being given, the monitoring circuits provide an audible signal, which can be quite inconvenient and annoying. Sometimes the annoyance is such that the user will disable the smoke detector to silence it. Then, the user may forget that he has disabled the smoke detector which renders the detector useless.

Second, as to the timing of the low battery report, the monitoring circuits sound the annoying signal at the moment that it detects that the capacity of the battery is unacceptable, including and most often in the middle of the night. The circuit does not give the user a reasonable period of time to replace the battery before sounding the low battery report. Consequently, the user is notified of a low battery condition in a very unpleasant manner and often at an inconvenient time.

Furthermore, during the daytime hours when the temperature is most likely warmer than the temperature in the middle of the night, the audible low battery report may cease because the increase in temperature helps the battery provide more energy. This change in the status of the acceptability of the battery only serves to further annoy and confuse the user as to whether the battery needs to be replaced.

Clearly, there is a need for a smoke sensor which, upon detecting a low battery condition, will inhibit the sounding of an audible low battery report for a predetermined amount of time and, while doing so, will provide a convenient and non-annoying report of the low battery condition to the user and/or a central station through the system controller of the security system. The predetermined inhibition period allows the user, after being prompted by the non-annoying low battery notice, to replace the battery. If the battery is not replaced during this time period, then the conventional low battery report may be sounded. Thus, such a circuit will notify the user in a more pleasant and convenient manner.

B. Sensor Testing

With respect to a second aspect of the invention, some prior art hardwired smoke sensors (i.e., those smoke sensors which are connected to system controllers by wire cable, not by radio frequency transmissions) provide two types of electrical outputs—a pre-alarm signal and an alarm signal. A pre-alarm signal is provided when the smoke sensor detects the build up of dust or smoke within the sensor, which is almost enough to cause an alarm. Thus, the pre-alarm signal allows the user to clean the sensor before it falsely produces an alarm condition. On the other hand, the smoke sensor will produce an alarm signal when a certain amount of smoke is detected by the sensor, and this signal is typically communicated to a central station or a local fire department. When a pre-alarm signal is followed by an alarm signal within a second of each other, this combination of the pre-alarm signal and the alarm signal provides greater assurance that the alarm condition was caused by the detection of smoke.

Smoke sensors should be periodically tested to be sure that the smoke sensor is functioning properly. In the prior art, when a smoke sensor in a security system is tested, a system controller will report an alarm condition to an off-premises location such as the local fire station, unless the security system is placed in a test mode. The user, having to place the security system in a test mode, is inconvenienced. As a result of this inconvenience, the user is less likely to test the smoke sensor and thus more likely to generate a false alarm because of dust build-up. In certain areas of the country, when a false alarm brings the fire department to the location of the alarm, the owner of the residence must pay a fine. Consequently, reducing the number of false alarms would be in the best interests of the owner of the security system and the fire departments.

Thus, there is a need for a smoke sensor in a security system which provides output signals indicative of dust build up and smoke detection, and can be tested without having to place the security system in a test mode. In particular, a circuit which (i) thoroughly tests the smoke-sensing sensor; (ii) provides a pre-alarm signal; and (iii) provides a system controller with the capability of recognizing that the alarm condition from a smoke sensor was caused by the actuation of a test button on the smoke sensor, as opposed to the sensing of smoke, would provide the user with a more convenient apparatus for testing a smoke sensor.

SUMMARY

The invention relates to a security system with distributed sensors, such as a smoke detector, that can be tested by actuating a test button on the sensor. The relevant security system includes a remote monitoring station. In the event of alarm condition being detected at the sensor, the remote monitoring station notifies the proper authorities, such as the police or fire departments.

The invention features a method and apparatus for testing a sensor when the security system is in a normal operating mode. The sensor is tested by actuating the sensor's test button. Actuation of the button generates a signal indicating that a test has been actuated. Actuation of the button also generates, if the sensor is working properly, a signal indicative of an alarm condition. If, when an alarm signal is generated, a test signal is also generated, the security system determines that it was a test that caused the alarm signal and not an actual alarm, and thus will not allow the forwarding of an alarm signal to the remote monitoring station.

Among the advantages of the invention are one or more of the following. By being able to distinguish, when the security system is in the normal operating mode, whether an alarm signal was generated by actuation of the sensor's test button or by detection of actual alarm conditions, it is possible to test the sensor without first placing the security system in a test mode. The invention thus makes it easier to test the sensor. The invention also eliminates the threat of false alarms arising from a sensor being tested without the security system being placed in a test mode. Other advantages and features will become apparent from the following description and from the claims.

BRIEF DESCRIPTION OF THE DRAWINGS

FIG. 6 shows a state table when the smoke sensor has detected smoke, dust, and an actuated test button signal.

FIG. 12 is a waveform diagram illustrating the operation of the test button detector circuitry when the test button is actuated.

DETAILED DESCRIPTION

Figure 1:
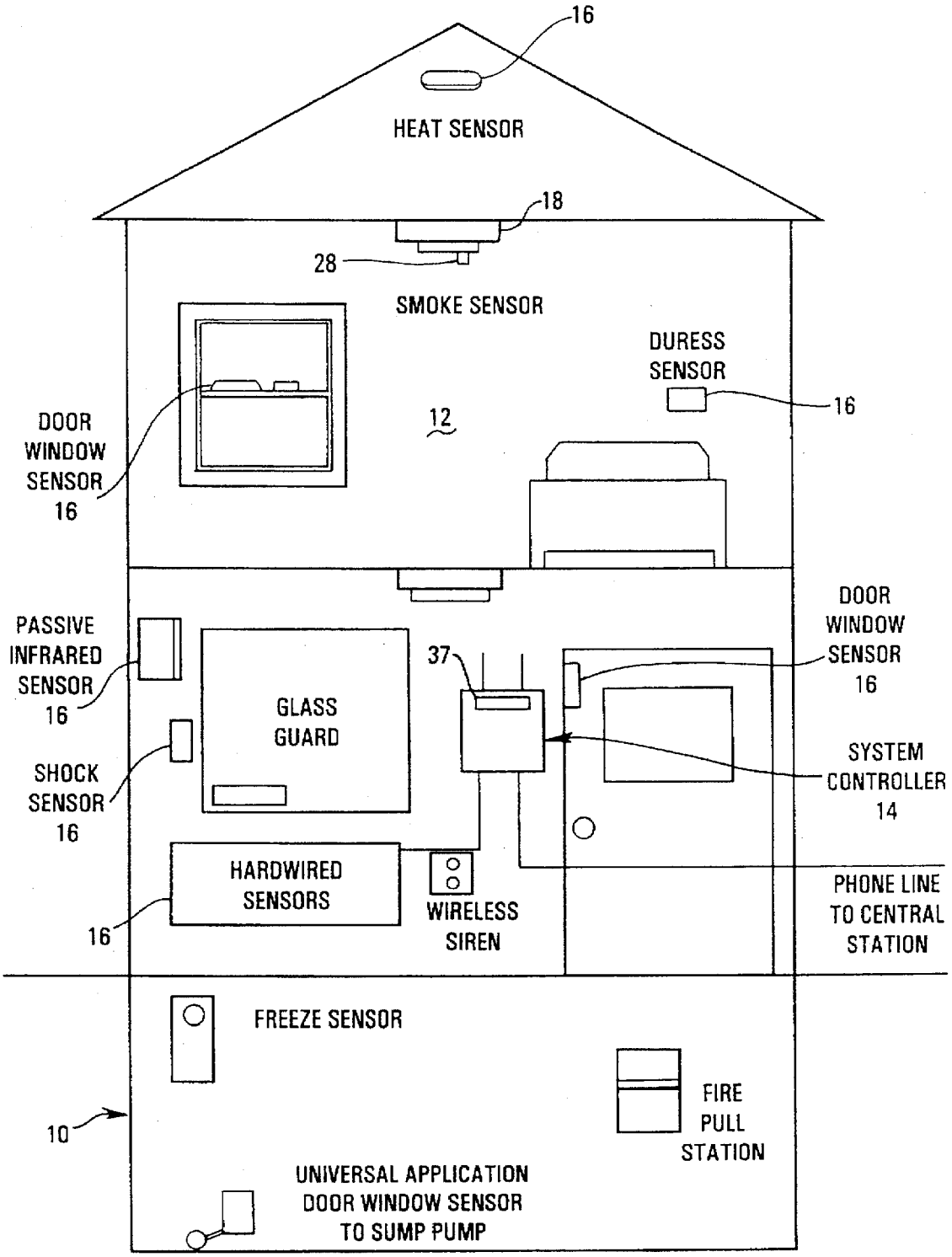
FIG. 1 shows a facility having a security system, a variety of sensors including a smoke sensor, and a system controller.

FIG. 1 illustrates a home or a facility 10 with a security system 12. The security system 12 has a system controller (or control panel) 14 with a visual display 37 and a variety of sensors 16 including a smoke sensor or smoke detector 18. The system controller 14 reports conditions in the house or facility 10 by telephone to an off-premises, remote monitoring station such as a central station or a fire station (not shown).

Figure 2:
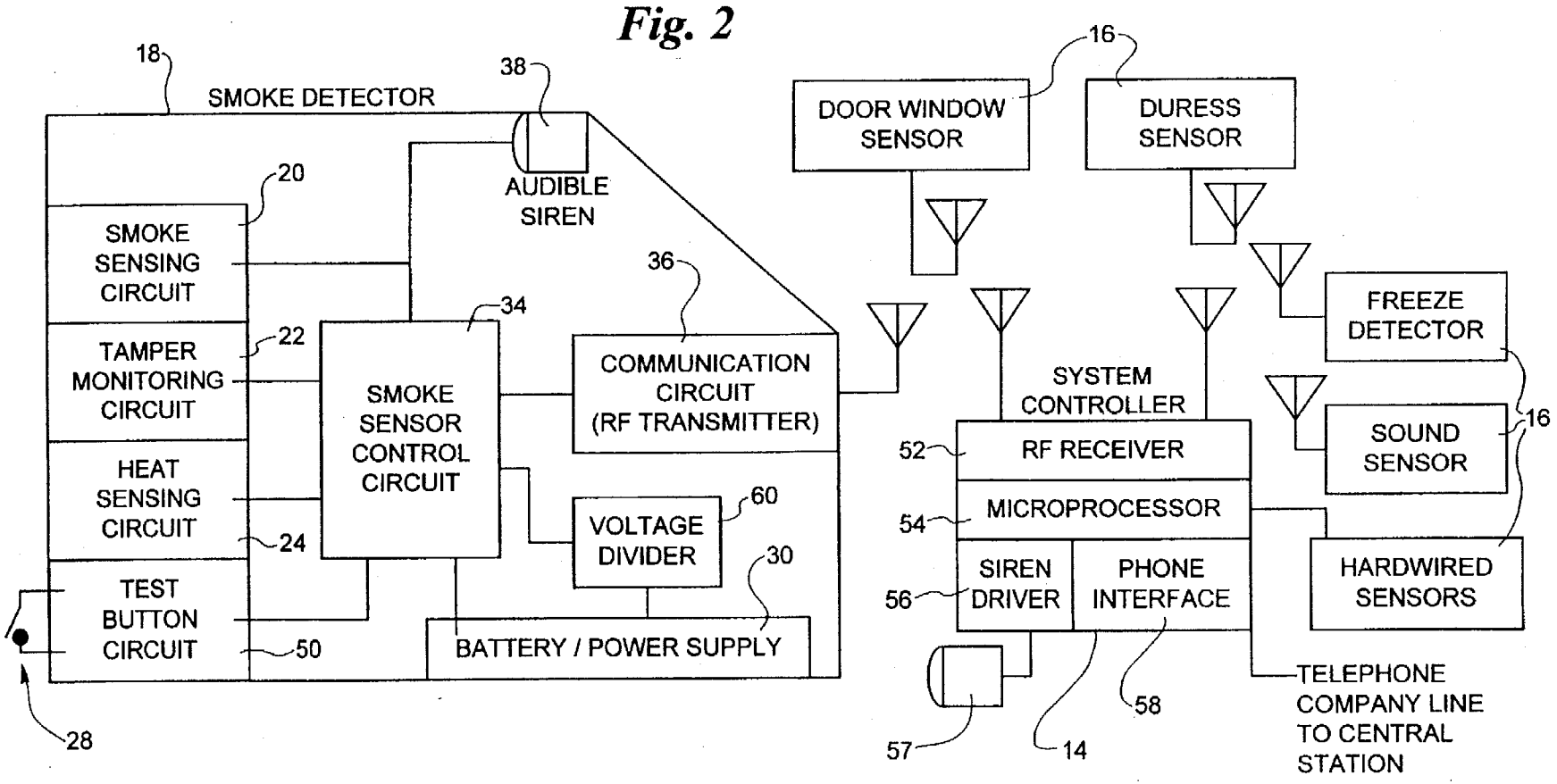
FIG. 2 shows a block diagram of the circuitry in a smoke sensor and a system controller.

FIG. 2 shows a block diagram of the smoke detector 18, the system controller 14, and a variety of other sensors 16. The smoke detector 18 has a smoke sensing circuit 20, a tamper monitoring circuit 22, a heat sensing circuit 24, a test button circuit 50 with a test button 28, a battery 30, a voltage divider 60, a smoke sensor control circuit 34, a communication circuit 36, and an audible siren 38. The smoke sensor control circuit 34 includes circuitry for both aspects of the present invention: the apparatus for reporting the battery condition and the apparatus for detecting whether an alarm condition was caused by smoke or by depressing the test button 28 on the smoke sensor 18.

The system controller 14 has an RF receiver 52, a microprocessor 54, a siren driver 56, a siren 57, and a phone interface 58. The system controller 14 will receive messages: (i) transmitted via modulated radio frequencies from a wireless sensor 16, such as the smoke sensor 18; and (ii) from hardwired sensors 16, which may also include a smoke sensor 18, which are physically, electrically connected to the system controller 14. The microprocessor 54 will decode the messages from the sensors and report, via the phone interface 58, emergency conditions to a central station (37 of FIG. 1) and notify the user by activating the siren 57. Also, the system controller 14 will notify the user of the security system 12 through a visual display (not shown) in which a message is displayed.

A. Low-Battery Reporting

Figure 3:
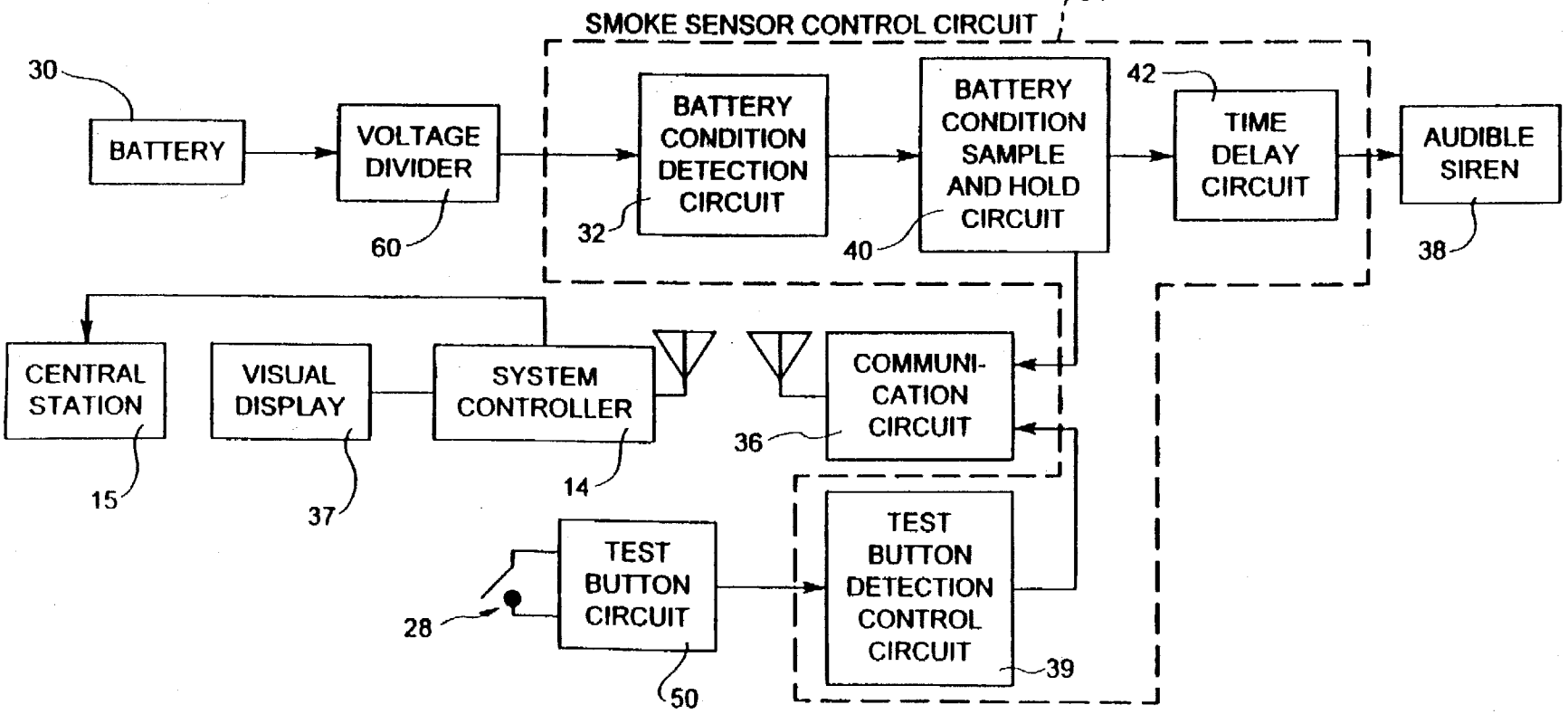
FIG. 3 shows a block diagram of the low battery reporter circuit and its relationship to the test button circuit and the test button detection control circuit.

First, in reference to FIG. 3, the apparatus for reporting the condition of a battery 30 in a smoke sensor 18 will be described. FIG. 3 shows a block diagram of a battery 30, a voltage divider 60, a smoke sensor control circuit 34, and how those circuits interconnect to the remainder of the system 12. As shown in FIG. 3, the battery 30 is connected to a voltage divider 60, and the voltage divider 60 is connected, in turn, to a battery condition detection circuit 32. The battery condition detection circuit 32 is connected to the battery condition sample and hold circuit 40. The battery condition sample and hold circuit 40 is connected to a time delay circuit 42 and a communication circuit 36. The time delay circuit 42 is connected to the audible siren 38. The communication circuit 36 is connected via modulated radio frequency transmissions to the system controller 14 which includes a visual display 37. The system controller 14 is also connected to a remote central station 15 by way of a telephone line. The battery condition detection circuit 32, the battery condition sample and hold circuit 40 and the time delay circuit 42 are part of the smoke sensor control circuit 34.

The battery 30, which is in the smoke sensor 18, is connected to the voltage divider 60 to provide the battery condition detection circuit 32 with a reduced voltage. The reduced voltage from the voltage divider 60 is constantly monitored by the battery condition detection circuit 32. This battery condition detection circuit 32 outputs a signal representative of the condition of the battery 30. The battery condition sample and hold circuit 40 periodically samples the output of the battery condition detection circuit 32. The battery condition sample and hold circuit 40 outputs a low battery condition from the battery condition detection circuit 32 to the communication circuit 36 and the time delay circuit 42 if the battery condition has remained low/weak for two or more successive samples.

By using modulated radio frequencies, the communication circuit 36 transmits the battery condition from the battery condition sample and hold circuit 40 to the system controller 14. When a low battery condition is transmitted to the system controller 14, a first indicator indicates the low voltage condition of the battery 30. This first indicator can be the visual display 37 at the system controller 14, which would be seen by the user when the user arms/disarms the security system 12. Also, the first indicator can be an audio message to the user from the system controller 14 indicating that a low battery condition exists, which will be provided to the user when the user arms/disarms the security system 12. Alternatively, the first indicator may be provided by the smoke sensor 18 itself, for example, by a flashing light emitting diode on the smoke sensor 18. In each of these embodiments, the first indicator is a passive report that notifies the user of the low battery condition in a pleasant manner. Thus, the user is not disturbed by an annoying alarm at the moment a low battery condition is detected.

Also, the time delay circuit 42 receives the output from the battery condition sample and hold circuit 40. When a low battery condition is received by the time delay circuit 42, the time delay circuit 42 begins to count for a predetermined time period. If the battery 30 has not been replaced before the predetermined time period has lapsed, then the audible siren 38 will be enabled to make a chirping sound. Alternatively, some other active report of the unacceptable battery condition could be made. If the battery 30 is replaced so that the low battery condition no longer exists, then the audible siren 38 will not be enabled to make a chirping sound. This time delay circuit 42 provides the user with a relatively convenient period of time to replace the battery 30 from the first time notice is given to the user by the passive report. Consequently, the effect of this apparatus is that the audible siren 38 is inhibited from making the chirping sound for a predetermined time period to allow a low battery to be replaced.

Figure 4A:
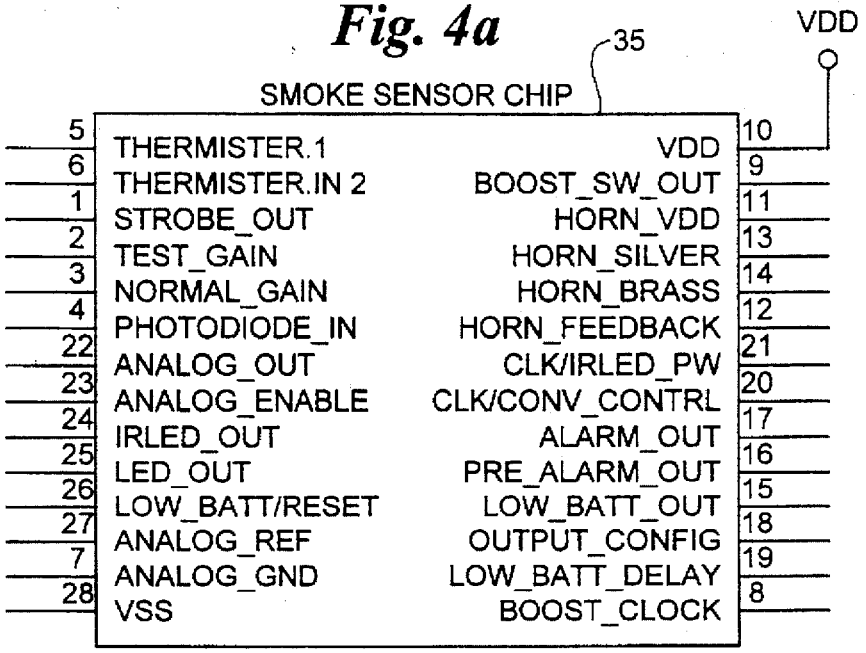
FIG. 4*a* shows the names and numbers of the pins of the smoke sensor chip.

Now turning to FIGS. 4*a*, 4*b*, 4*c*, 4*e*, 4*f*, and 4*g*, the circuit comprising the first aspect of the present invention is illustrated. FIG. 4*a* illustrates a smoke sensor chip 35 implemented in a custom made 28-pin integrated circuit. The pin numbers and the various names of the inputs and outputs of chip 35 are also indicated on the diagram. In the preferred embodiment, the battery condition detection circuit 32, the battery condition sample and hold circuit 40, and the time delay circuit 42 are all on the smoke sensor chip 35. However, one or more of these circuits could be comprised of discrete components on a circuit board or implemented in separate integrated circuits. The functions pertinent to the present invention performed by the smoke sensor chip 35 will be described at appropriate places in this section.

Figure 4B:
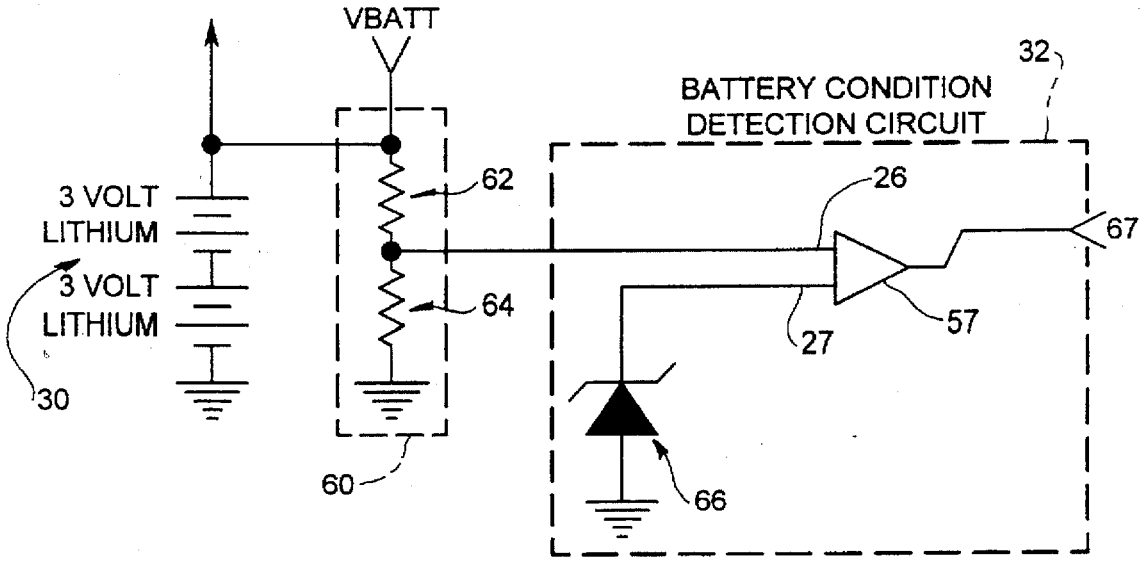
FIG. 4*b* shows a battery, a voltage divider, and the battery condition detection circuit.

FIG. 4*b* illustrates the battery 30, the voltage divider 60, a Zener diode 66, which is part of the battery condition detection circuit 32, and how these parts connect to pins 26 and 27 of the smoke sensor chip 35. In the preferred embodiment, as shown in FIG. 4*b*, the smoke sensor 18 uses two 3-volt lithium batteries 30. However, the present invention is applicable to any smoke sensor 18 with any number or types of batteries 30 as its power supply.

Continuing to refer to FIG. 4*b*, the voltage divider 60 includes a first resistor 62 and a second resistor 64. The two resistors 62, 64 are connected to each other in series. The battery 30 is connected in parallel to the resistors 62, 64. The voltage across the second resistor 64 is connected to pin 26, the LOW_BATT/RESET pin, of the smoke sensor chip 35.

As shown in FIG. 4*b*, the battery condition detection circuit 32 constantly monitors the voltage of the battery 30 and determines if the voltage is low. The condition of the battery 30 is determined when the battery is loaded. That is, the condition of the battery 30 is determined when it is supplying current to the rest of the circuit. The battery condition detection circuit 32 comprises the Zener diode 66 and a comparator 57, which is contained in the smoke sensor chip 35.

As shown in FIG. 4*b*, the Zener diode 66 is connected to pin 27 of the smoke sensor chip 35 and to the battery 30 via a resistor. The current through the resistor to the Zener diode 66 produces a voltage across the Zener diode 66. This voltage across the Zener diode 66 provides a reference voltage to which the voltage across the second resistor 64 of the voltage divider 60 is compared. This reference voltage is provided to pin 27, the ANALOG_REF pin, of the smoke sensor chip 35.

The comparator 57 has two inputs which are connected to pins 26 and 27 of smoke sensor chip 35. Thus, one input to the comparator 57 is supplied with the voltage across the second resistor 64 in the voltage divider 60 via pin 26 of the smoke sensor chip 35. The second input to the comparator 57 is connected to pin 27 of the smoke sensor chip 35. Thus, this second input to the comparator 57 is connected to the reference voltage across the Zener diode 66. The output from the battery condition detection circuit 32 is connected to the battery condition sample and hold circuit 40.

In operation, the comparator 57 determines if the voltage across the second resistor 64 is less than or greater than the reference voltage across the Zener diode 66. If the voltage across the second resistor 64 is greater than the reference voltage 66, then the comparator 57 will output a LOW output state. If the voltage across the second resistor 64 is less than the reference voltage 66, then the comparator 57 will output a HIGH output state. Consequently, a HIGH output state from the comparator 57 represents a low battery voltage condition.

Figure 4C:
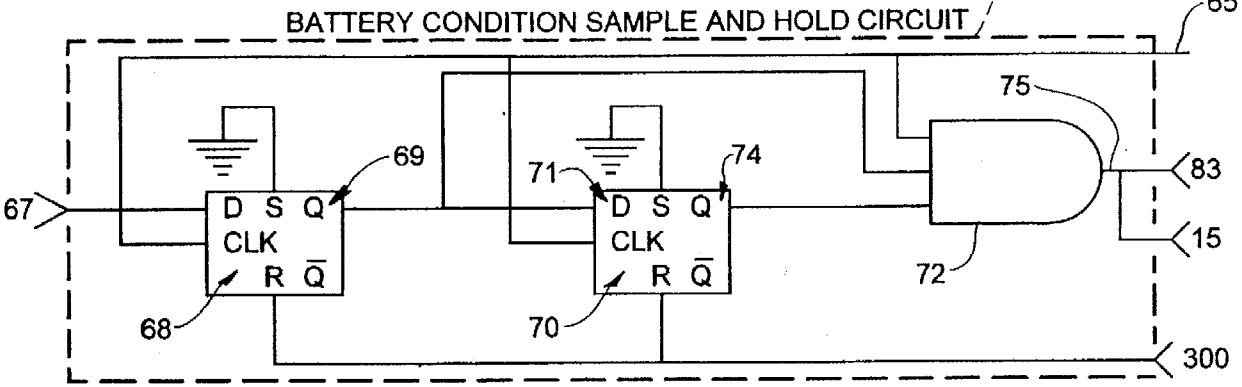
FIG. 4*c* shows the battery condition sample and hold circuit.

In FIG. 4*c*, the battery condition sample and hold circuit 40, which is also contained in the smoke sensor chip 35, is illustrated. The battery condition sample and hold circuit 40 is used in the present invention to reduce the chances of the communication circuit 36 transmitting a false low battery voltage condition. The chances of a false low battery voltage condition being transmitted are lowered by the battery condition sample and hold circuit 40 because the battery condition sample and hold circuit 40 will only output a low battery condition if it has sampled two consecutive low battery voltage conditions at the output of the comparator 57. If the comparator 57 outputs a low battery condition but then corrects itself before the battery condition sample and hold circuit 40 can sample the comparator's 57 output a second time, then a low battery voltage condition will not be transmitted. Thus, the battery condition sample and hold circuit 40 ensures that a low battery voltage condition exists before transmitting the low battery condition. However, the battery condition sample and hold circuit 40 is not necessary to practice the present invention. The comparator's 57 output can be directly connected to the communication circuit 36, which will transmit the detected condition to the system controller 14.

In the preferred embodiment, the battery condition sample and hold circuit 40 comprises a first D flip-flop 68, a second D flip-flop 70, and a three input AND-gate 72. The comparator's 57 output is connected to the D-input 67 of the first D flip-flop 68. The Q-output 69 of the first D flip-flop 68 is connected to the D-input 71 of the second D flip-flop 70 and to one of the three inputs of the AND-gate 72. The Q-output 74 of the second D flip-flop 70 is output from the smoke sensor chip 35 through pin 15, the LOW_BATT_OUT pin. Also, the Q-output 74 of the second D flip-flop 70 is connected to one of the inputs of the AND-gate 72. The output 75 of the AND-gate 72 is connected to the clock input 83 of the time delay circuit 42. A forty second clock signal 65 is also connected to one of the inputs of the AND-gate 72 and the clock inputs of the D flip-flops 68, 70. The resets 300 of the D flip-flops 68, 70 are tied together.

In operation, the forty second clock 65 enables the D flip-flops 68, 70. If the comparator 57 outputs a LOW output state, then the voltage of the battery 30 in the smoke sensor 18 is acceptable. If the comparator 57 outputs a HIGH output state, then the battery 30 in the smoke sensor 18 is in a low voltage condition, i.e., the battery 30 contains an unacceptable amount of energy and the batteries 30 in the smoke sensor 18 must be replaced.

The output from the comparator 57 is sampled by the battery condition sample and hold circuit 40 every forty seconds. When a HIGH output state is input at the D-input 67 of the first D flip-flop 68, the D flip-flop 68 outputs a HIGH output state through its Q-output 69. The D flip-flop 68 outputs the state at the D-input 67 only when the clock 65 enables the D flip-flop 68. In the preferred embodiment, the D flip-flop 68 is enabled every forty seconds by the forty second clock 65.

Figure 4F:
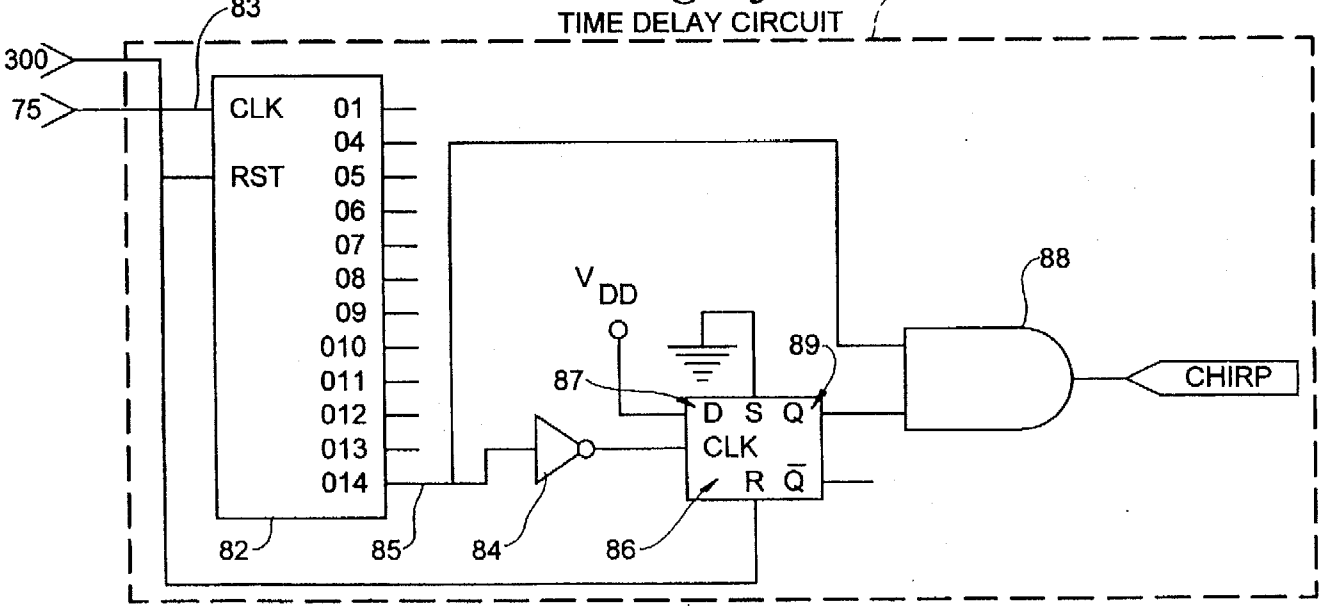
FIG. 4*f* illustrates the time delay circuit and how it connects to other circuitry.
Figure 4D:
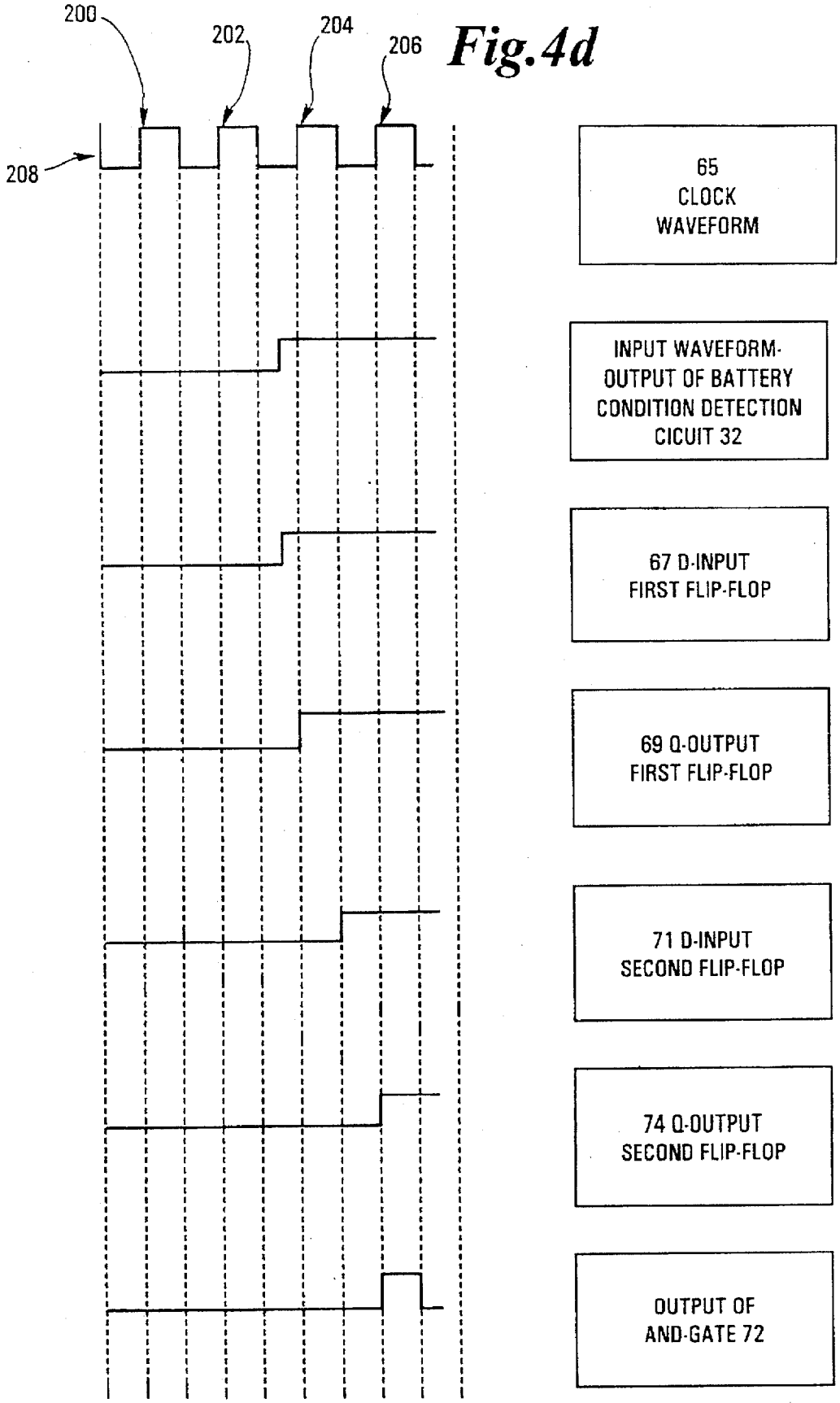
FIG. 4*d* is a waveform diagram illustrating the operation of the battery condition sample and hold circuit.

FIG. 4*d* graphically illustrates the operation of the battery condition sample and hold circuit 40. The clock waveform 208 represents the forty second clock waveform 65. The clock waveform 208 shown in FIG. 4*d* has a first clock pulse 200, a second clock pulse 202, a third clock pulse 204, and a fourth clock pulse 206. The input waveform represents the output from the comparator 57, which will be input at the D-input 67 of the first D flip-flop 68. The other waveforms represent the inputs and outputs of the D flip-flops 68, 70 and the output of the AND-gate 72. When the clock waveform 65 goes from LOW to HIGH, the D flip-flops 68, 70 are enabled. When the D flip-flops 68, 70 are enabled, the input state at the D-input is output through the Q-output of the respective D flip-flops 68, 70.

At the first clock pulse 200, the output of the comparator 57 from the battery condition detection circuit 32 is in a LOW state. This LOW state is input into the D-input 67 of the first D flip-flop 68. When the first clock pulse 200 occurs, the Q-output 69 outputs a LOW state corresponding to the LOW state at the D-input 67. If prior to the first clock pulse 200, the Q-output 69 was in a LOW state, then the LOW state will be input into the D-input 71 of the second D flip-flop 70. At the first clock pulse 200, a LOW state is output by the Q-output 74 which corresponds to the LOW state at the D-input 71.

At the second clock pulse 202, the LOW output state output by the first D flip-flop 68 is output at the Q-output 74 of the second D flip-flop 70.

When the comparator 57 outputs a HIGH output state, this state is at the D-input 67 of the first D flip-flop 68. However, as shown in FIG. 4*d*, the value of the D-input 67 will only be output at the Q-output 69 when the clock signal goes from a LOW state to a HIGH state. When the third clock pulse 204 goes to a HIGH state, the first D flip-flop 68 outputs a HIGH output state through the Q-output 69 because of the HIGH input state at the D-input 67.

During this third clock pulse 204, the LOW output at the Q-output 69 of the first D flip-flop 68, which existed before the third clock pulse 204 went from a LOW state to a HIGH state, is the input at the D-input 71 of the second D flip-flop 70. This LOW input state at the D-input 71 is output as a LOW output state through the Q-output 74 of the second D flip-flop 70.

During the third clock pulse 204, the Q-output 69 of the first D flip-flop 68 is outputting a HIGH output state, the Q-output 74 of the second D flip-flop 70 is outputting a LOW output state, and the third clock pulse 204 is at a HIGH state. The AND-gate 72 will output a LOW output state because an AND-gate 72 only outputs a HIGH output state when all three inputs are in a HIGH input state.

At the fourth clock pulse 206, when the comparator 57 continues to output a HIGH output state, the Q-output 69 of the first D flip-flop 68 will output a HIGH output state. The previous HIGH output state from the Q-output 69 of the first D flip-flop 68 will be clocked through the second D flip-flop 70, and a HIGH output state will be output by the Q-output 74 of the second D flip-flop 70. Consequently, all three inputs to the three input AND-gate 72 will be in the HIGH input state. The AND-gate 72 will output 75 a HIGH output state, indicating the existence of a low battery condition.

The waveforms depicted in FIG. 4*d* graphically illustrate that the battery condition sample and hold circuit 40 must sample a low battery voltage condition twice, i.e., a HIGH output state from the comparator 57 in the battery condition detection circuit 32, for a low battery condition to be clocked through the two D flip-flops 68, 70 and the AND-gate 72.

Next, attention will be turned to the configuration and operation of the communication circuit 36. As illustrated in FIG. 3, the output of the battery sample and hold circuit 40 is connected to the communication circuit 36. The communication circuit 36 transmits information such as the condition of the battery 30, by way of a modulated radio frequency signal, to the system controller 14. The detailed operation of the communication circuit 36 for transmitting information such as the condition of the battery 30 is explained in U.S. Pat. No. 4,864,636 to Brunius and in U.S. Pat. No. 5,223,801 to Bergman which are herein incorporated in full by reference.

Figure 4E:
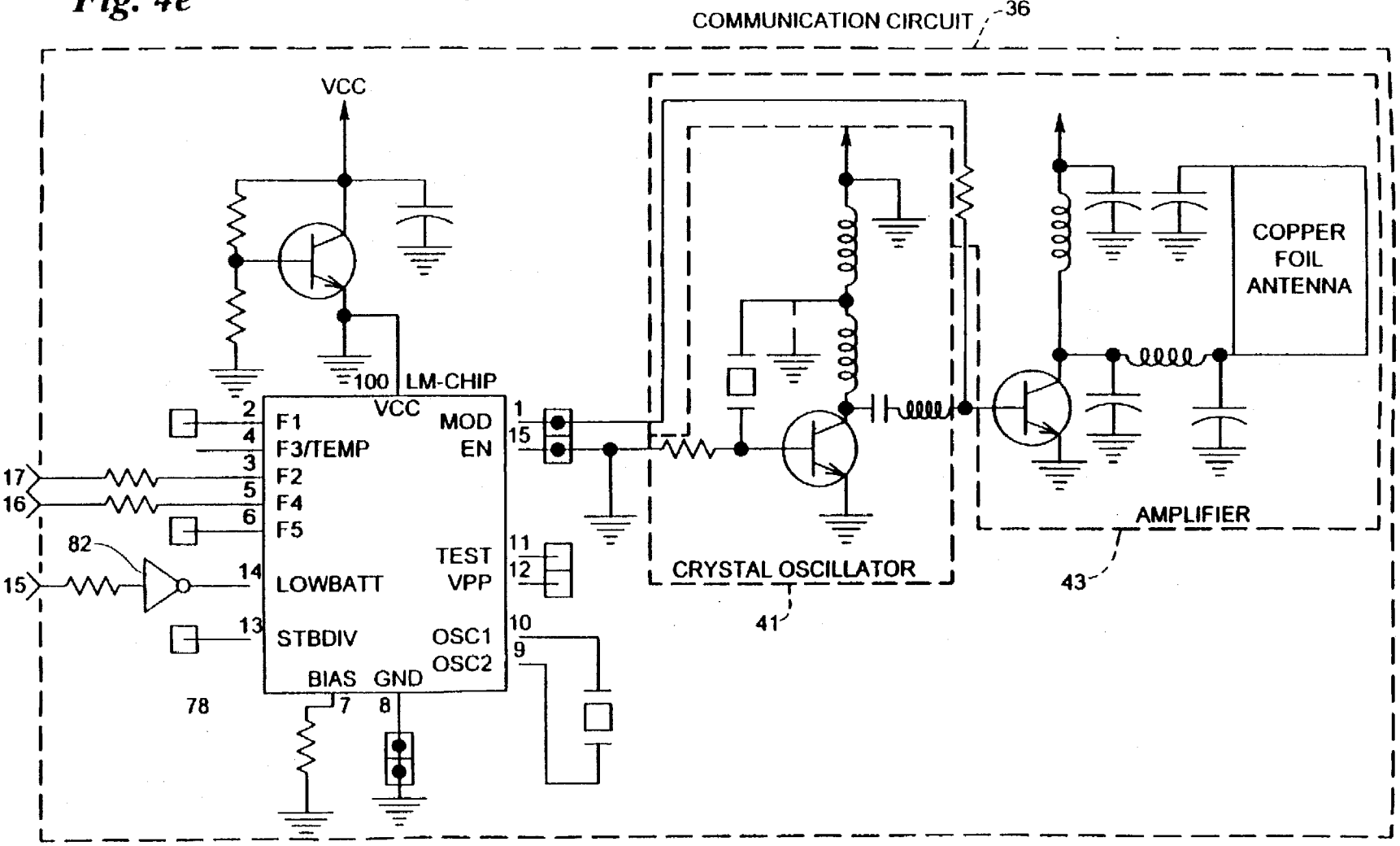
FIG. 4*e* illustrates the communication circuit and how it connects to the smoke sensor chip.

An overview of the operation of the communication circuit 36 will now be given with reference to FIG. 4*e*. As shown in FIG. 4*e*, the communication circuit 36 comprises a transmitter chip 78, a crystal oscillator 41, and an amplifier 43. Pin 15, the LOW_BATT_OUT pin, of the smoke sensor chip 35, which outputs the condition of the battery 30, is electrically connected to pin 14, the LOWBATT pin, of the transmitter chip 78. An inverter 82 is interposed between the smoke sensor chip 35 and the transmitter chip 78 because the output of the smoke sensor chip 35 is active high and the input to pin 14 of the transmitter chip 78 is active low.

In operation, the low battery condition received by the transmitter chip 78 is output to the crystal oscillator 41. The crystal oscillator 41 self-produces a carrier frequency at the third harmonic of the fifth overtone of the crystal's fundamental frequency. The low battery condition is transmitted to the system controller 14 by the amplifier 43 through amplitude modulation.

Now, a description of the system controller 14 will be provided. The system controller 14 receives, decodes, and reports conditions to the user and a remote monitoring station such as a central station 15. The system controller 14 also provides the user with a visual display 37 of certain information, and the capability of arming/disarming or otherwise controlling the system 12.

As shown in FIGS. 2 and 3, the communication circuit 36 is connected to the system controller 14 by an RF link. The system controller 14, which is located in a location remote from the smoke sensor 18, has circuitry to receive the signals transmitted by the communication circuit 36. The detailed operation of the system controller 14 is described in U.S. Pat. No. 4,951,029 to Severson and is hereby incorporated in full.

When a battery condition is transmitted, the system controller 14 will decode the transmitted signal to determine the condition of the battery 30. When a low battery condition is transmitted, the system controller 14 will display to the user via display 37 that a low battery condition exists. Such a visual display 37 will be seen by the user when the system 12 is being armed/disarmed. Also, the system controller 14 could report the condition to an off-premises remote monitoring station such as a central station 15 via the telephone interface 58, and the central station 15 can then notify the user of the low battery condition or can send a repairman to the location of the smoke sensor 18 to replace the battery 30.

The present invention also includes a time delay circuit 42. When a low battery voltage condition is detected, the time delay circuit 42 delays sounding the audible siren 38 for a period of time. In the following, the detailed operation of the time delay circuit 42 will be described.

As shown in FIG. 4*f*, the time delay circuit 42, which is located inside the smoke sensor chip 35, comprises a 14-bit counter 82, an inverter 84, and a D flip-flop 86. The output 75 from the AND-gate 72 of the battery condition sample and hold circuit 40 (FIG. 4*c*) is connected to the counter 82 at its clock input 83. The counter output 85 is connected to the input of the inverter 84. The output from the inverter 84 is connected to the clock input of the D flip-flop 86. The D-input 87 of the D flip-flop 86 is tied to $V_{DD}$ making it always HIGH. When the clock input changes from a LOW state to a HIGH state, the HIGH state input at the D-input 87 is clocked through to the output, thereby causing the audible siren 38 to make a chirping sound.

Every time the output 75 of AND-gate 72 in the battery condition sample and hold circuit 40 is a HIGH state (indicating a low voltage condition), the counter 82 is incremented by one. In the preferred embodiment, since a forty second clock 65 is being used, each count will equal a forty second period of time. The counter 82 is configured such that when a particular count is reached, the audible siren 38 will be sounded. The time period for remedying the low battery condition detected in the battery 30 is set at the factory when this apparatus is manufactured. In the preferred embodiment, the predetermined time period is set at seven days. However, the predetermined time period can be manipulated by connecting the input of the inverter 84 and one of the inputs of the AND-gate 88 to any other output of the counter 82 or any combination of outputs of the counter 82.

The predetermined time period has elapsed when the counter 82 changes from a HIGH state to a LOW state through its output 85 to the inverter 84. The D-flip-flop 86 will output a HIGH output state since the D input is HIGH and is clocked to the output pin. When the counter 82 was outputting a LOW output state, the clock on the D flip-flop 86 was HIGH. Since the D-input 87 of the D flip-flop 86 is tied to HIGH by connection to $V_{DD}$, the Q-output 89 outputs a HIGH output state when the flip-flop is clocked. The Q-output 89 stays latched at a HIGH output state until the power-on reset signal resets the flip-flop. This output is connected internally within the smoke sensor chip 35 to enable the audible siren 38 to make a chirping sound. When this outputs a HIGH output state, an audible siren 38 will be enabled to make a chirping sound. Thus, this chirping sound made by the audible siren 38 will be inhibited for the predetermined time period. If the low battery condition is not resolved before the predetermined time period elapses, then the audible siren 38 will make the chirping sound.

Also, when the battery 30 is replaced, the counter 82 is reset.

The final circuit of this first aspect of the invention is the clock divider circuit 44. The clock divider circuit 44 provides clock signals of various frequencies to vary the speed at which the various circuits on the smoke sensor chip 35 operate.

Figure 4G:
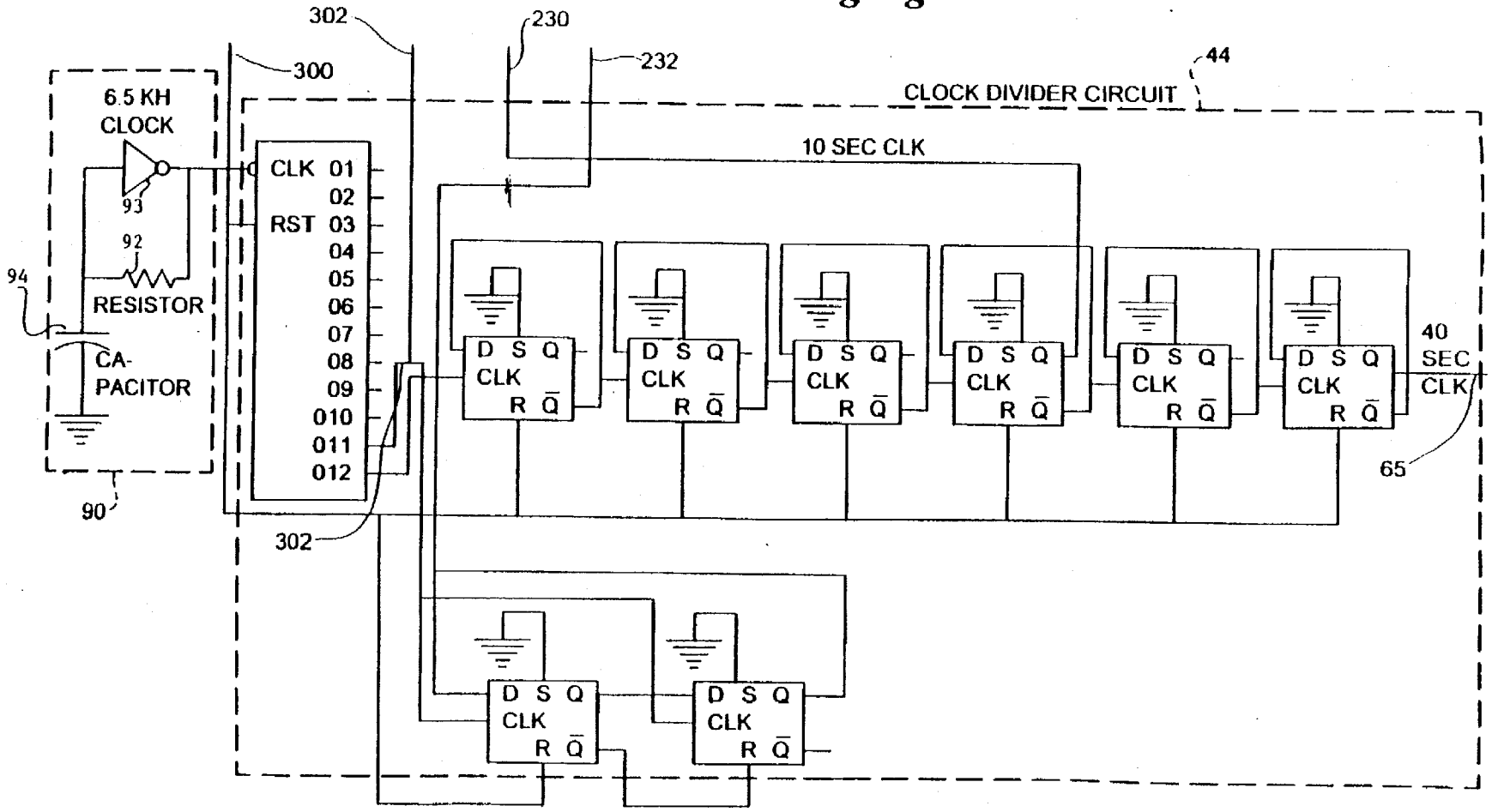
FIG. 4*g* shows the clock divider circuit and how it connects to other circuitry.

As shown in FIG. 4*g*, all the clocks used in the operation of the low battery reporter circuit 34 and the test button detector circuit 39 are the result of a clock divider circuit 44, which is located on the smoke sensor chip 35. The clock divider circuit 44 provides a forty second clock 65, a ten second clock 230, and a one second clock 232. To obtain the forty second clock 65, the ten second clock 230, and the one second clock 232, the frequency of a clock 90 on the smoke sensor 18 is divided by clock divider circuit 44. The clock 90 comprises an inverter 93, a resistor 92, and a capacitor 94. The input of the inverter 93 is connected to one end of the capacitor 94. The other end of capacitor 94 is connected to ground. The node 95 which connects the inverter 93 and capacitor 94 also connects to one end of resistor 92. The other end of resistor 92 is connected to the output of inverter 93.

In operation, when capacitor 94 charges above a threshold voltage, inverter 93 will output a LOW state. When the output of inverter 93 is in a LOW state, the voltage in capacitor 94 will discharge through resistor 92. When the voltage across capacitor 94 is below another threshold voltage, inverter 94 will output a HIGH state. This HIGH state will cause the voltage across capacitor 94 to increase. This cycle of changing states of the inverter 93 based on the voltage in the capacitor 94 produces a clock. In the preferred embodiment this clock circuit 90 produces a 6.5 KHz clock (6,500 Hertz or 6,500 cycles/second). Also, a crystal or a ceramic resonator may be used to provide a clock. The division of clock 90 is accomplished in a manner well known to digital designers by using an array of D flip-flops (as shown in FIG. 4*g*), which divides the input frequency down to the desired rate.

The clock divider circuit 44 provides the forty second clock 65 used to enable the D flip-flops 68, 70 of the battery condition sample and hold circuit 40.

In the following, the operation of the first aspect of the invention will be described with general reference to FIGS. 4*a*–4*g*. When a low battery voltage condition exists, the voltage across the second resistor 64 of the voltage divider 60 will be less than the voltage across the Zener diode 66. The comparator 57 of the battery condition detection circuit 32 will output a HIGH state, indicating that a low battery voltage condition exists. Also, the clock divider circuit 44 will provide a forty second clock 65 to enable the battery condition sample and hold circuit 40.

The battery condition sample and hold circuit 40 will output a HIGH state through the AND-gate's 72 output 75, thereby indicating a low battery voltage condition, once it has sampled two consecutive low battery voltage conditions within a period of approximately eighty seconds. The communication circuit 36 and the time delay circuit 42 receive the low battery voltage condition output from the AND-gate 72 of the battery condition sample and hold circuit 40.

The communication circuit 36 will amplitude modulate an RF signal to transmit the low battery voltage condition to the system controller 14. The system controller 14 will display a message on its visual display 37 indicating to the user that the battery 30 in the smoke sensor 18 is in a low voltage condition. Also, the system controller 14 will report the low battery voltage condition to the central station 15 by telephone line. A repairman may be sent to replace the battery 30 in the smoke sensor 18.

The time delay circuit 42 receives the low battery voltage condition every forty seconds. Every time the low battery voltage condition signal is received, the counter 82 in the time delay circuit 42 is incremented. When a predetermined count corresponding to a predetermined time period (e.g. 7 days) has elapsed, the time delay circuit 42 will enable the audible siren 38 to make a chirping sound, unless the low battery voltage condition has been remedied. Once the low battery is replaced, the counter 82 is reset.

Thus, this first aspect of the invention avoids the annoying and often inconvenient alarm indicating a low battery condition in a smoke detector 18. Instead, the user of the smoke detector 18 is alerted to the low battery condition by a visual display 37 and given a period of time to replace the battery 30 in the smoke detector 18.

B. Sensor Testing

Next, a second aspect of the present invention will be described. The second aspect of the invention is an electronic system which tests the operability of a sensor, such as a smoke sensor 18, which is part of a security system 12, without having to place the security system 12 in a test mode and without activating a false alarm. In particular, this second aspect of the invention allows a system controller 14 in the security system 12 to determine whether an alarm condition generated by a smoke sensor 18 was caused by the actuation of a test button 28 on the smoke sensor 18 or by the detection of smoke. By using this second aspect of the present invention, the smoke sensing circuit 20 and the other critical portions of a smoke sensor 18 may be tested without placing the system controller 14 in a test mode and without falsely alerting a central station, a remote monitoring station, or a fire department.

As shown in FIG. 1, a house or facility 10 has a security system 12. The security system 12 has a system controller 14 and a variety of sensors 16. The security system 12 also has a smoke sensor 18 with a test button 28.

FIG. 2 shows a block diagram of the smoke sensor 18, the system controller 14, and a variety of other sensors 16. The smoke sensor 18 has a smoke sensing circuit 20, a test button circuit 50 with a test button 28, a smoke sensor control circuit 34, and a communication circuit 36. The system controller 14 has a RF receiver 52, a microprocessor 54, and a phone interface 58.

FIG. 3 shows a block diagram of the smoke sensor control circuit 34 and how it interconnects with the rest of the system 12. FIG. 3 shows the test button circuit 50 with the test button 28, test button detection control circuit 39, the communication circuit 36, the system controller 14 with the visual display 37, and the central station 15.

The test button circuit 50 with the test button 28 is connected to the test button detection control circuit 39. The test button detection control circuit 39 is connected to the communication circuit 36, which, in turn, is connected via modulated RF to the system controller 14. The system controller 14 has a visual display 37 and is connected to a remote monitoring station such as the central station 15.

Figure 5:
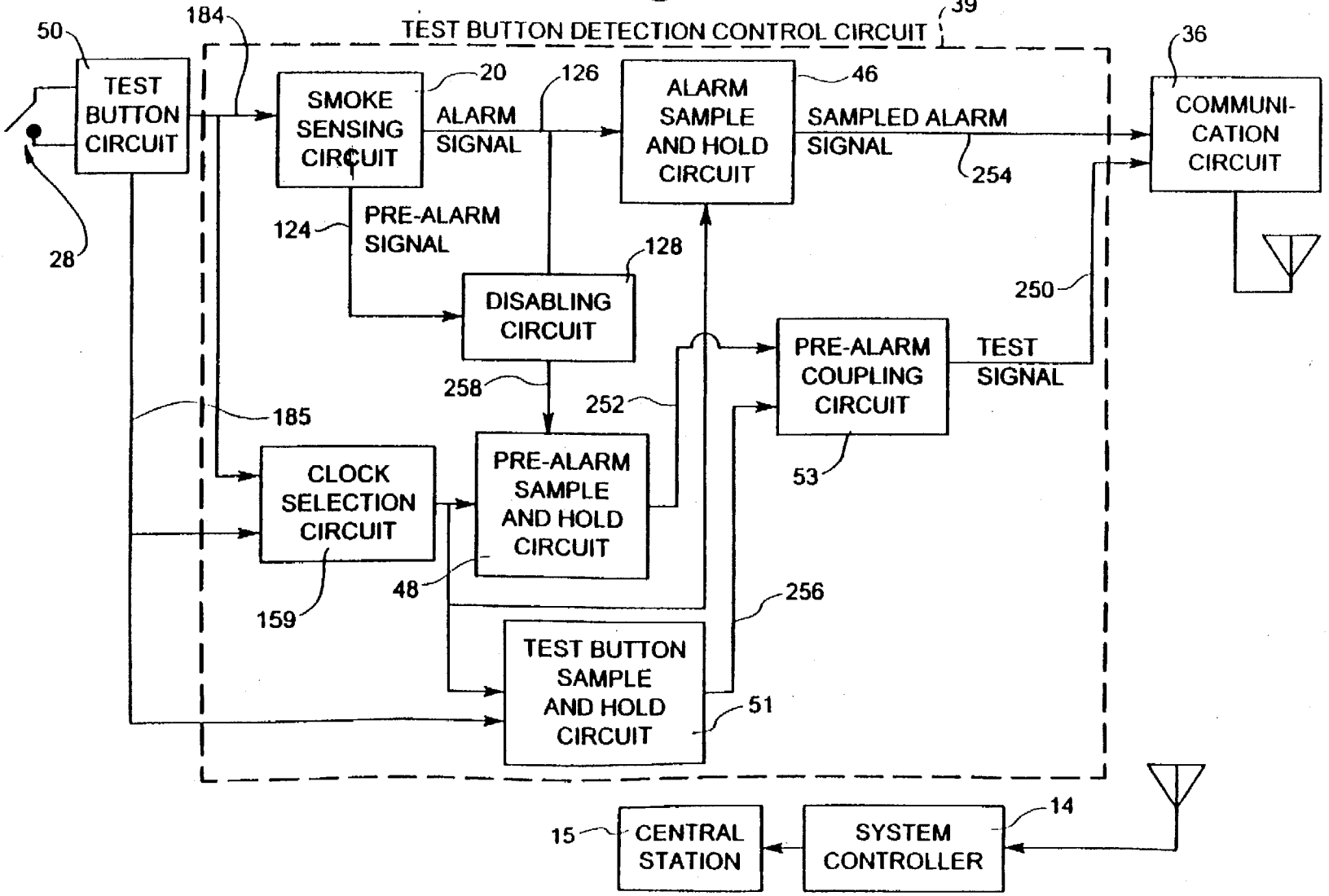
FIG. 5 shows a block diagram of the test button detection control circuit.

FIG. 5 shows a block diagram of the test button circuit 50, the test button detection control circuit 39, and how those circuits interconnect to the remainder of the system 12. As shown in FIG. 5, the test button 28 is connected to the test button circuit 50. The test button circuit 50 is connected to the smoke sensing circuit 20 via line 184, the clock selection circuit 159 via line 184 and 185, and the test button sample and hold circuit 51 via line 185. The smoke sensing circuit 20 is connected to the alarm sample and hold circuit 46 via line 126 and the disabling circuit 128 via line 124. The disabling circuit 128 is connected to the pre-alarm sample and hold circuit 48. The pre-alarm sample and hold circuit 48 and the test button sample and hold circuit 51 are connected to the pre-alarm coupling circuit 53. The clock selection circuit 159 is connected to the alarm sample and hold circuit 46, the pre-alarm sample and hold circuit 48, and the test button sample and hold circuit 51. The alarm sample and hold circuit 46 and the pre-alarm coupling circuit 53 are connected to the communication circuit 36 via lines 254 and 250 respectively. The communication circuit 36 is connected to the system controller 14, and the system controller 14 is connected to the central station 15. The smoke sensing circuit 20, the alarm sample and hold circuit 46, the disabling circuit 128, the clock selection circuit 159, the pre-alarm sample and hold circuit 48, the test button sample and hold circuit 51, and the pre-alarm coupling circuit 53 are part of the smoke sensor control circuit 34.

By way of the communication circuit 36, the test button detection control circuit 39 transmits two signals, a test signal 250 and a sampled alarm signal 254, to the system controller 14, each signal having two states. The test signal 250 is placed in the HIGH state under either of the following two conditions: (i) when sufficient dust or smoke accumulates on the sensing unit 20 (thereby causing a HIGH pre-alarm condition); or (ii) when the test button 28 is depressed. The dust or smoke induced test signal condition is transmitted when the smoke sensing unit 20 outputs a HIGH pre-alarm condition via the pre-alarm signal 124 because the smoke sensing unit 20 does not sense sufficient smoke to output an alarm condition but does sense sufficient smoke or dust build up to output a pre-alarm condition. When there is not sufficient smoke or dust build up in the smoke sensing unit 20, the pre-alarm signal 124 from the smoke sensing unit 20 is LOW. Thus, a HIGH test signal 250 indicates that either the smoke sensing circuit 20 detected sufficient dust build-up, a small amount of smoke, or the test button 28 was depressed. A LOW test signal 250 indicates that (i) the smoke sensing circuit 20 did not detect sufficient smoke or dust build up; and (ii) the test button 28 was not depressed.

The second signal output by test button detection control circuit 39 is the sampled alarm signal 254. The sampled alarm signal 254 goes HIGH under either of the following two conditions: (i) when a certain amount of smoke is detected by the smoke sensing circuit 20; or (ii) when the test button 28 is depressed. A LOW sampled alarm signal 254 indicates that there has been neither a detection of smoke nor an actuation of the test button 28. If the alarm signal 126, the sampled alarm signal 254, the pre-alarm signal 124, the sampled pre-alarm signal 252, the test button signal 256, and the test signal 250 are in a LOW state, then neither an alarm condition, a pre-alarm condition, nor an actuated test button condition is present.

With the test button circuit 50 in conjunction with the test button detection control circuit 39, the system controller 14 will not report an alarm condition caused by the actuation of the test button 28. Thus, the test button circuit 50 in conjunction with the test button detection control circuit 39 provides the system controller 14 with the capability to distinguish between an alarm condition caused by the actuation of the test button 28 and an emergency alarm caused by smoke.

In the following, and with reference to FIGS. 5 and 6, the processing by the smoke sensor 18 of (i) the detection of smoke, (ii) the detection of dust, and (iii) the detection of an actuated test button condition, which occurs when the test button 28 is depressed, will be briefly described. FIG. 6 is a table indicating the logic levels of the alarm signal 126, the sampled alarm signal 254, the pre-alarm signal 124, the output 258 of the disabling circuit 128, the sampled pre-alarm signal 252, the sampled test button signal 256, and the test signal 250.

First, the processing of the detection of smoke by the smoke sensor 18 will be described. As shown in FIGS. 5 and 6, when a certain amount of smoke is detected, the smoke sensing circuit 20 generates an alarm signal 126, shown by the HIGH state under the column titled "alarm signal 126". The alarm sample and hold circuit 46 samples the alarm signal 126 and outputs a sampled alarm signal 254. As shown in FIG. 6, the sampled alarm signal 254 is in the HIGH state.

Furthermore, when the smoke sensing circuit 20 detects smoke, the smoke sensing circuit 20 outputs a HIGH pre-alarm signal 124, as shown under the column titled "pre-alarm signal 124". In response to a HIGH state, the disabling circuit 128 provides a LOW signal 258 to the pre-alarm sample and hold circuit 48. The pre-alarm sample and hold circuit 48 samples the output from the disabling circuit 128 and outputs a pre-alarm sampled signal 252. Because a LOW signal was provided to the pre-alarm sample and hold circuit 48, a LOW pre-alarm sampled signal 252 is output, indicating that a pre-alarm condition (i.e., excessive dust build-up or a small amount of smoke) does not exist.

The test signal 250 will be HIGH if either a HIGH pre-alarm condition or a HIGH test button condition is input into the pre-alarm coupling circuit 53. Because, in the case of the detection of smoke, neither a HIGH sampled pre-alarm signal 252 nor a HIGH test button condition 256 is input into the pre-alarm coupling circuit 53, the test signal 250 is LOW.

The communication circuit 36 transmits to the system controller 14 a HIGH alarm sampled signal 254, indicating the detection of smoke, but a LOW test signal 250, indicating that neither a pre-alarm condition nor an actuated test button condition exist. Upon receiving the transmission from the communication circuit 36, the system controller 14 reports the alarm condition (i.e., the detection of smoke) to a remote monitoring station such as the central station 15. Also, the system controller 14 may turn on the lights or take other appropriate actions depending on the configuration of the system controller 14.

Next, the processing of a detection of dust or a sufficient amount of smoke to cause a pre-alarm signal by the smoke sensor 18 will be described. When the smoke sensing circuit 20 detects a sufficient build-up of dust or a sufficient amount of smoke, the smoke sensing circuit 20 outputs a HIGH pre-alarm signal 124, indicating that a pre-alarm condition exists. When the smoke sensing unit 20 detects a sufficient build-up of dust or a sufficient amount of smoke to trigger a pre-alarm condition, the alarm signal 126 is LOW, indicating that an alarm condition does not exist. A greater amount of smoke is necessary to trigger an alarm condition than a pre-alarm condition. The alarm sample and hold circuit 46 samples the alarm signal 126 and outputs a LOW sampled alarm signal 254. Having a HIGH pre-alarm signal 124 and a LOW alarm signal 126, the disabling circuit's 128 output 258 will be in a HIGH state, indicating that a pre-alarm condition exists. The pre-alarm sample and hold circuit 48, which is connected to the output 258 of the disabling circuit 128, outputs a HIGH pre-alarm sampled signal 252.

The test button sampled signal 256 is LOW, indicating that the test button 28 was not depressed. The pre-alarm coupling circuit 53 will output a HIGH test signal 250 because a HIGH pre-alarm condition was input into the pre-alarm coupling circuit 53.

The communication circuit 36 will transmit a LOW sampled alarm signal 254, indicating the nonexistence of an alarm condition, and a HIGH test signal 250, indicating the existence of the pre-alarm condition. Upon receiving this transmission, the system controller 14 will report the pre-alarm condition (i.e., the excessive build-up of dust) to the central station 15.

Now, the processing of the detection of the actuation of the test button 28 will be described. When the test button 28 on the smoke sensor 18 is depressed, the test button circuit 50 causes the smoke sensing circuit 20 to react as if smoke had been detected. Thus, as shown in FIG. 6, the alarm signal 126 is in the HIGH state, indicating an alarm condition. Therefore, the sampled alarm signal 254 is in the HIGH state.

Furthermore, when the test button 28 is depressed, the smoke sensing circuit 20 outputs a HIGH pre-alarm signal 124. Having received a HIGH alarm signal 126 and a HIGH pre-alarm signal 124, the disabling circuit 128 will output a LOW signal 258 indicating that there is no pre-alarm condition. Thus, the pre-alarm sampled signal 252 will be output in a LOW state.

Also, when the test button 28 has been actuated, the test button sampled signal 256 will be in a HIGH state, indicating an actuated test button condition. The pre-alarm coupling circuit 53 will output a HIGH test signal 250 because a HIGH sampled test button signal 256 was input into the pre-alarm coupling circuit 53, indicating that the test button 28 was depressed.

The communication circuit 36 will transmit a HIGH sampled alarm signal 254, indicating an alarm condition, and a HIGH test signal 250, indicating that the test button 28 is depressed. Upon receiving that transmission, the RF receiver 52 will demodulate the transmitted signal and output to the microprocessor 54 the HIGH sampled alarm signal 254 and the HIGH test signal 250. The microprocessor 54 will contain a computer program which will use the two signals and determine if the alarm condition was induced by depressing the test button 28 or by the detection of smoke. To make this determination, the computer program causes the two signals to be compared and if both signals are HIGH, then the program will prohibit the system controller 14 from reporting the alarm condition to the central station 15. Thus, upon receiving that transmission, the system controller 14 will not report the alarm condition to the central station 15 because the system controller 14 received both a HIGH sampled alarm signal 254 and a HIGH test signal 250. (This receiving of a HIGH sampled alarm signal 254 and a HIGH test signal 250 is to be contrasted to the earlier examples where smoke or dust was detected, and either the test signal 250 or the sampled alarm signal 254 was in a LOW state.)

Thus, when the system controller 14 receives HIGH states for both the test signal 250 and the sampled alarm signal 254 from the communication circuit 36, it determines that the alarm condition was caused by the depression of the test button 28 and not by smoke. Consequently, because of the operation of the test button circuit 50 in conjunction with the test button detection control circuit 39, the system controller 14 can determine if an alarm condition was caused by the actuation of the test button 28 or by the detection of smoke. Thus, in a smoke detector which includes pre-alarm signalling capability, this invention allows a thorough testing of the test button detection control circuit 39, including the smoke sensing circuit 20, without falsely communicating the detection of smoke to the central station 15 and without placing the system controller 14 in a test mode.

In the following, a detailed operation of the apparatus for determining whether an alarm condition was caused by the actuation of the test button 28 or by the detection of smoke will be described.

Figure 7:
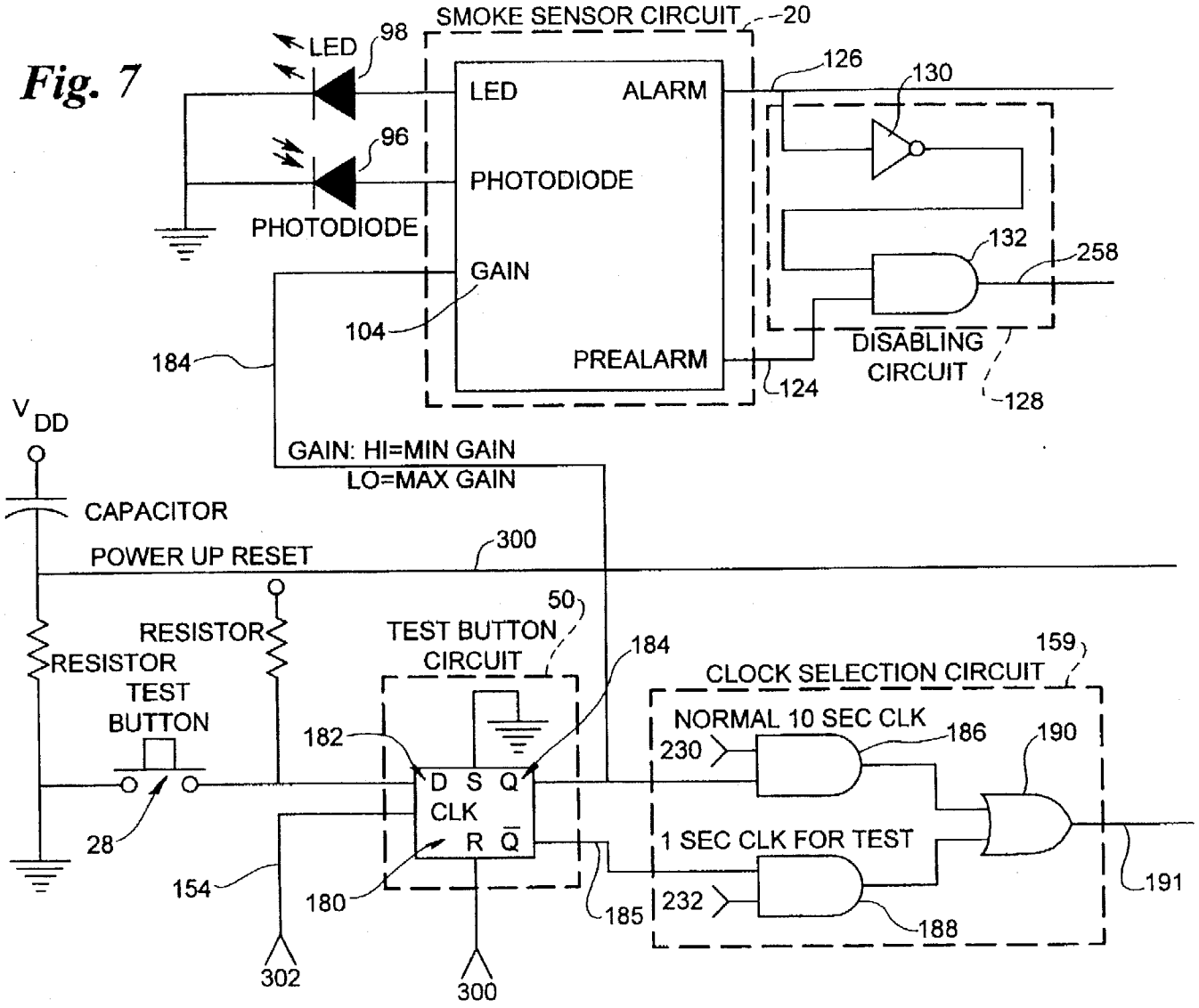
FIG. 7 illustrates the smoke sensing circuit, the disabling circuit, the test button circuit, and the clock selection circuit and how these circuits interconnect.

Referring to FIG. 7, the test button circuit 50, clock selection circuit 159, smoke sensing circuit 20, and the disabling circuit 128 are illustrated. The test button circuit 50 periodically monitors the test button 28 to determine if the test button 28 has been depressed. Upon detecting that the test button 28 has been depressed, the test button circuit 50 activates the smoke sensing circuit 20 to output an alarm condition to the system controller 14. Also, the test button circuit 50 causes a HIGH test signal 250 to be transmitted to the system controller 14.

As shown in FIG. 7, the test button circuit 50, which is in the smoke sensor chip 35, comprises a D flip-flop 180 coupled to the test button 28. The D-flip-flop 180 has a D-input 182, a Q-output 184, and a Qbar-output 185. The D flip-flop 180 is enabled via line 154 by a 315 millisecond ("ms") clock 230. In the preferred embodiment, the test button 28 is actuated by depressing the button 28. When the test button 28 is not actuated, the D-input 182 is in a HIGH state. When the test button 28 is actuated, the D-input 182 is in a LOW state. When the D flip-flop 180 is enabled by the 315 ms clock 230, the input state at the D-input 182 is output through the Q-output 184 and the opposite state of the input state at the D-input 182 is output at the Qbar-output 185. The Q-output 184 is connected to the gain circuit 104 of the smoke sensing circuit 20 and the clock selection circuit 159 (both of which will be described later). The Qbar-output 185 is connected to the clock selection circuit 159 and the test button sample and hold circuit 51 (both of which will be described later).

In operation, when the test button 28 is actuated, the D-input 182 is in a LOW state. When the D flip-flop 180 is enabled by the clock, the Q-output 184 is in a LOW state and the Qbar-output 185 is in a HIGH state. The HIGH output state of the Qbar-output 185 indicates that the test button 28 has been actuated.

Figure 8:
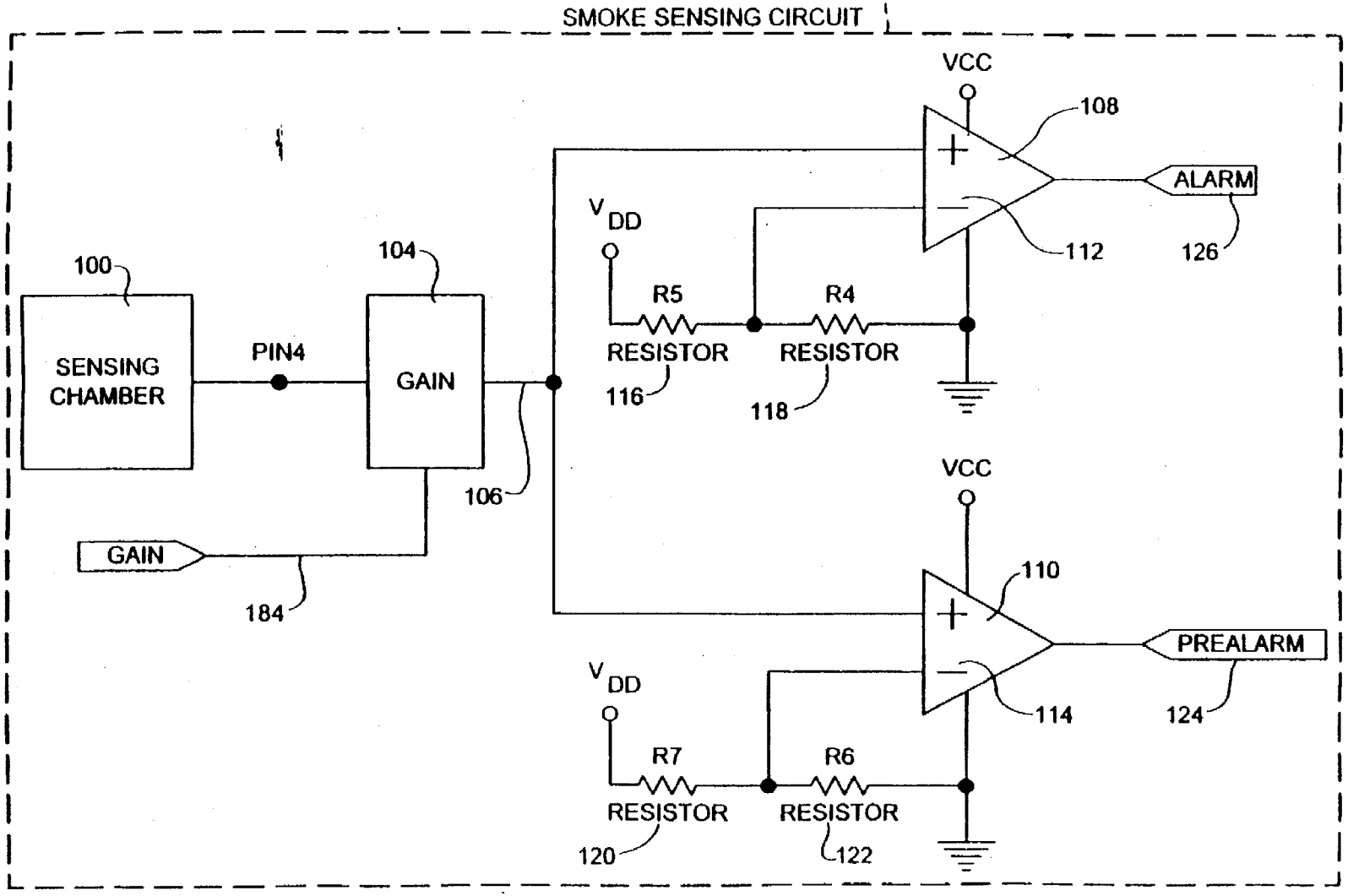
FIG. 8 shows the smoke sensing circuit and how it connects to the smoke sensor chip.

FIG. 8 is a diagram of the smoke sensing circuit 20 of the smoke sensor 18, which is used in the present invention to detect smoke or dust in the immediate vicinity of the smoke sensor 18. As shown in FIG. 8, the smoke sensing circuit 20 is comprised of a smoke sensing chamber 100 which is connected to a gain or amplifier circuit 104 through pin 4 of the smoke sensor chip 35. The output 106 from the gain circuit 104 is connected to an alarm comparator 108 and a pre-alarm comparator 110. The gain circuit 104, the alarm comparator 108, and the pre-alarm comparator 110 are in the smoke sensor chip 35. The output of the alarm comparator 108 is an alarm'signal 126. The alarm signal 126 is input into the disabling circuit 128 and the alarm sample and hold circuit 46 (both of which will be described later). The pre-alarm comparator's 110 output is a pre-alarm signal 124. The pre-alarm signal 124 is input into the disabling circuit 128. In the following, the detailed operation of the smoke sensing circuit 20 will be described, with reference to FIGS. 8 and 9.

Figure 9:
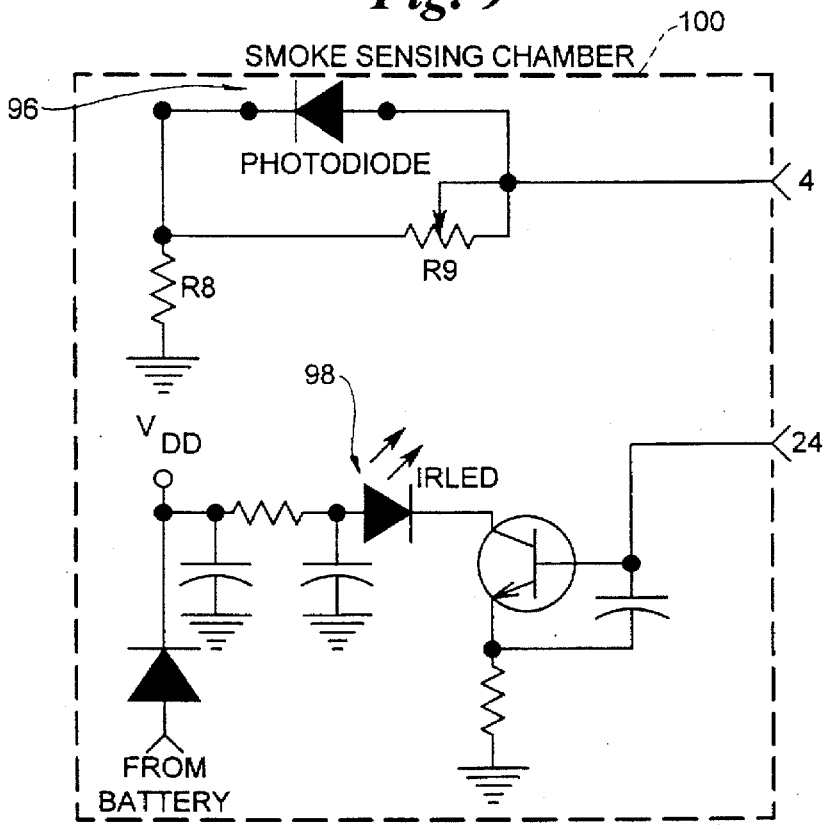
FIG. 9 shows the circuit of the smoke sensing chamber.

FIG. 9 illustrates the circuit of the smoke sensing chamber 100 and how it interconnects with the smoke sensor chip 35. The photodiode 96 and the light emitting diode ("IRLED") 98 are housed in the sensing chamber 100. The voltage across resistors R8 and R9, as a function of the conductivity of photodiode 96, is connected to pin 4 of the smoke sensor chip 35, which is called the PHOTODIODE_IN pin. The IRLED 98 is connected to pin 24 of the smoke sensor chip 35 which turns on and off to sample for a smoke condition.

The IRLED 98, which serves as a light source, and the photodiode 96, which serves as a light sensitive receiver, are arranged so that light from the source 98 does not normally strike the receiver 96. Smoke particles, upon entering the sensing chamber 100, reflect light from the source 98 onto the receiver 96 in proportion to the number of particles present. As light from the IRLED 98 is reflected onto the photodiode 96, a voltage is generated across the diode 96, which is input into the smoke sensor chip 35 through pin 4. Although a photoelectric-type smoke detector is used in the present invention, an ionization type smoke detector and other types of smoke detectors may also be used in the present invention.

As shown in FIG. 8, this diode voltage is amplified by the gain circuit 104, which outputs an amplified diode voltage 106. This amplified diode voltage 106 is input into the alarm comparator 108 and the pre-alarm comparator 110. A reference voltage is connected to the other terminal 112, 114 of each of the comparators 108, 110. This reference voltage is controlled by resistors R5 116 and R4 118 for the alarm comparator 108 and by resistors R7 120 and R6 122 for the pre-alarm comparator 110.

These resistive networks 116, 118, and 120, 122 are connected to a regulated smoke sensor battery 30. The voltage of the battery 30 is divided between the resistors 116, 118 and 120, 122. For the alarm comparator 108, the voltage across resistor R4 118 is the alarm reference voltage to which the amplified diode voltage 106 is compared. Similarly, for the pre-alarm comparator 110, the voltage across resistor R6 122 is the pre-alarm reference voltage to which the amplified diode voltage 106 is compared. In the preferred embodiment, the resistors R6 122 and R7 120 are selected so that when 85% of the voltage level required to trigger an alarm condition is the pre-alarm reference voltage. When the amplified diode voltage 106 is greater than the pre-alarm reference voltage, then the pre-alarm comparator 110 will output a HIGH state on the pre-alarm signal 124.

Similarly, the resistors R4 118 and R5 116 are selected so that when there is enough smoke in the smoke sensing chamber 100, the amplified diode voltage 106 is greater than the alarm reference voltage. When the amplified diode voltage 106 is greater than the alarm reference voltage, the alarm comparator 108 will output a HIGH output state.

When the smoke sensing circuit 20 detects smoke and outputs a HIGH alarm signal 126, it will also output a HIGH pre-alarm signal 124, because a greater voltage is required to cause the smoke sensing circuit 20 to output a HIGH alarm signal 126 than a HIGH pre-alarm signal 124. On the other hand, when the sensing chamber 100 only contains enough smoke or dust build-up to provide 85% of the voltage required to trigger an alarm condition, the amount of voltage input into pin 4 of smoke sensor chip 35 is enough to only cause the smoke sensing circuit 20 to output a HIGH pre-alarm signal 124.

Also, as shown in FIGS. 7 and 8, the test button circuit 50 is connected to the gain circuit 104 of the smoke sensing circuit 20 via line 184. When the test button 28 is actuated, the Q-output 184 is in a LOW state. This LOW state is input into the gain circuit 104, which produces the maximum gain or amplification of the diode voltage input at pin 4. With the maximum gain and without the presence of smoke or dust, the smoke sensing circuit 20 outputs both an alarm signal 126, indicating that an alarm condition exists, and a pre-alarm signal 126, indicating that a pre-alarm condition exists.

Continuing to refer to FIG. 7, the clock selection circuit 159 is illustrated. The clock selection circuit 159 will select between a ten second clock 230 and a one second clock 232 to enable the alarm sample and hold circuit 46, the pre-alarm sample and hold circuit 48, and the test button sample and hold circuit 51. The purpose for changing the frequency of the clock is to make testing the smoke sensor 18 more convenient to the user. If the ten second clock 230 were used when the test button 28 is depressed, then the user would have to depress the test button 28 for twenty seconds to ensure that the test button sample and hold circuit 51 will output a signal 258 that the test button 28 has been depressed. Thus, by using a one second clock 232, the test button 28 has to be depressed for only two seconds. On the other hand, a one second clock 232 is not consistently used because the battery 30 will have a shorter use life by having to power the alarm sample and hold circuit 46, the pre-alarm sample and hold circuit 48, and the test button sample and hold circuit 51 to perform their functions every one second rather than every ten seconds, when the ten second clock 230 is used.

Moreover, the clock selection circuit 159 synchronizes the operation of the alarm sample and hold circuit 46, the pre-alarm sample and hold circuit 48, and the test button sample and hold circuit 51. By synchronizing the operation of these three circuits, the system controller 14 will receive the sampled alarm signal 254 and the test signal 250 at generally the same time. By receiving the signals 254, 250 at the same time, the system controller 14 can determine if a transmitted alarm condition was caused by smoke or by actuation of the test button 28.

In the following, the detailed operation of the clock selection circuit 159 will be described.

As shown in FIG. 7, the clock selection circuit 159, which is in the smoke sensor chip 35, comprises a first two input AND-gate 186, a second two input AND-gate 188, and an OR-gate 190. The Q-output 184 of the D flip-flop 180 in the test button circuit 50 is connected to one of the two inputs in the first AND-gate 186. A ten second clock 230 is connected to the other input of the first AND-gate 186. The Qbar-output 185 of the D flip-flop 180 is connected to one of the two inputs of the second AND-gate 188. A one second clock 232 is connected to the other input of the second AND-gate 188. The outputs of the first AND-gate 186 and the second AND-gate 188 are connected to the two inputs of the OR-gate 190. The output 191 of the OR-gate 190 is connected to the clock pins 154 of all the D flip-flops in the alarm sample and hold circuit 46, the pre-alarm sample and hold circuit 48, and the test button sample and hold circuit 51.

When the test button 28 has not been actuated, the D-input 182 of the D flip-flop 180 is in the HIGH state. This HIGH state at the D-input 182 means that when the D flip-flop 180 is enabled by the 315 ms clock 230, the Q-output 184 will output a HIGH output state and the Qbar-output 185 will output a LOW output state. The first AND-gate 186 will have two inputs with HIGH states every ten seconds when the ten second clock 230 goes from a LOW state to a HIGH state. Thus, as long as the test button 28 is not actuated, the first AND-gate 186 will output a HIGH output state every ten seconds. Since the OR-gate 190 only requires one input to be in the HIGH state to output a HIGH state, the OR-gate 190 will also output a HIGH state every ten seconds. Thus, when the test button 28 is not actuated, all the D flip-flops in the alarm sample and hold circuit 46, the pre-alarm sample and hold circuit 48, and the test button sample and hold circuit 91 are enabled by a ten second clock 230. Also, when the test button 28 is not actuated, the LOW output state from the Qbar-output 185 will cause the second AND-gate 188 to output a LOW output state.

When the test button 28 is actuated, the D-input 182 is in a LOW state. When the D flip-flop 180 is enabled by the 315 ms clock 230, the Q-output 184 will output a LOW output state and the Qbar-output 185 will output a HIGH output state. Since the Q-output 184 is in the LOW state, the first AND-gate 186 will output a LOW state.

When the test button 28 is actuated, the D-input 182 is in a LOW state. When the D flip-flop 180 is enabled by the 315 ms clock 230, the Q-output 184 will output a LOW output state and the Qbar-output 185 will output a HIGH output state. Since the Q-output 184 is in the LOW state, the first AND-gate 186 will output a LOW state.

Since the Qbar-output 185 is in the HIGH state, the second AND-gate 188 will output a HIGH state every one second when the one second clock 232 goes from a LOW state to a HIGH state. The HIGH output state from the second AND-gate 188 every one second will cause the OR-gate 190 to output a HIGH output state every one second. Thus, all the D flip-flops in the alarm sample and hold circuit 46, the pre-alarm sample and hold circuit 48, and the test button sample and hold circuit 51 are enabled every one second.

Also, FIG. 7 illustrates the disabling circuit 128, which is connected to the smoke sensing circuit 20. In the present invention, when smoke is detected or the test button 28 is depressed, the disabling circuit 128 does not output a pre-alarm condition. The disabling circuit 128 permits the system controller 14 to distinguish between an alarm condition caused by depressing the test button 28 and one caused by sensing smoke. When the detection of smoke causes an alarm condition, the disabling circuit 128 ensures that by changing the pre-alarm condition to a signal indicating that the pre-alarm signal 124 does not exist, the system controller 14 only receives the alarm condition.

In the following, the detailed operation of the disabling circuit 128 will be described.

As shown in FIG. 7, the disabling circuit 128, which is in the smoke sensor ship 35, comprises an inverter 130 and a two-input AND-gate 132. The output from the inverter 130 is connected to one of the two inputs of the AND-gate 132. The disabling circuit 128 has a first input, a second input, and an output. The first input is one of the inputs into the AND-gate 132. This first input is connected to the pre-alarm output 124 of the smoke sensing circuit 20. The second input is the input into the inverter 130. This second input is connected to the alarm output 126 of the smoke sensing circuit 20. The output from the AND-gate 132 is the output 258 of the disabling circuit 128. Thus, the disabling circuit 128 couples the alarm signal 126 and the pre-alarm signal 124 from the smoke sensing circuit 20. The alarm signal 126 is input to the inverter 130. The pre-alarm signal 124 is connected to one of the inputs of the AND-gate 132.

In operation, when the pre-alarm signal 124 is HIGH, indicating the existence of a pre-alarm condition, and the alarm signal 126 is LOW, indicating that an alarm condition does not exist, the output 258 of the disabling circuit 128 is HIGH because the output of the inverter 130 is HIGH. Since both the inputs to the AND-gate 132 are in the HIGH input state, the AND-gate 132 will output a HIGH output state, indicating a pre-alarm signal 124. Thus, the pre-alarm signal 124, which is in the HIGH state, is not disabled by the disabling circuit 128.

However, when the pre-alarm signal 124 is HIGH and the alarm signal 126 is HIGH, the inverter 130 outputs a LOW output state, indicating that the pre-alarm signal 124 is not present at the output of the disabling circuit 128. Thus, the disabling circuit 128, by outputting a LOW output state does not output the pre-alarm signal 124.

Figure 10:
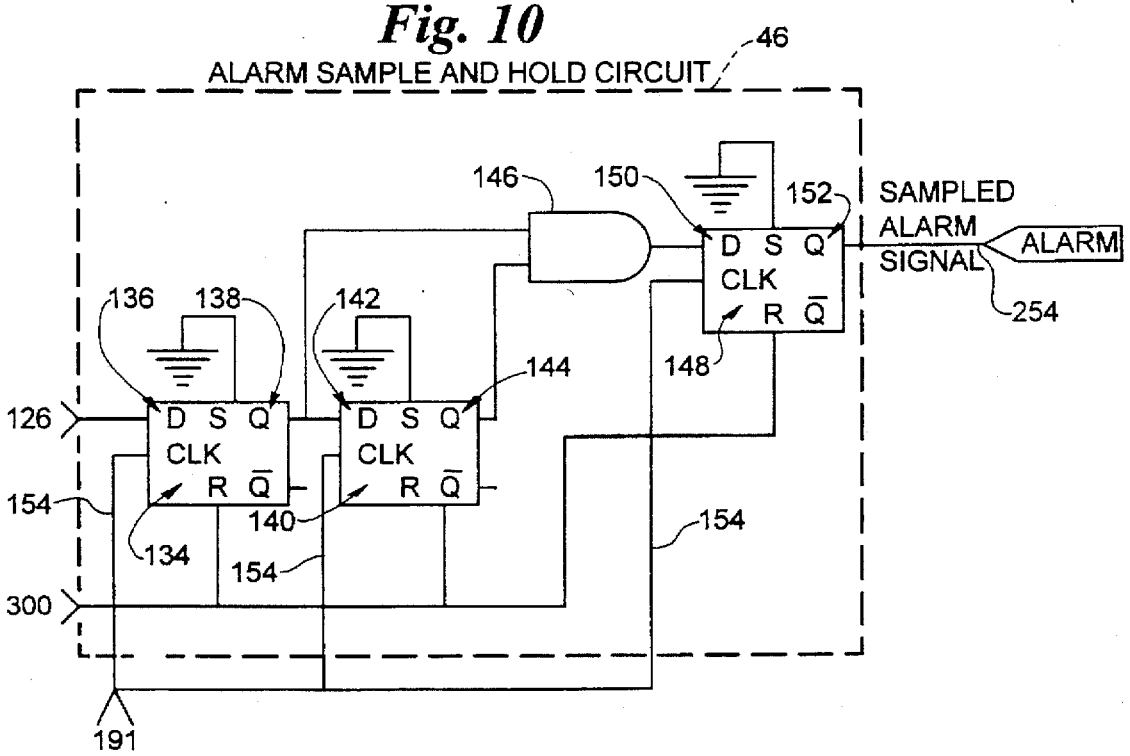
FIG. 10 shows the alarm sample and hold circuit.

Next, attention is directed to the alarm sample and hold circuit 46, which is illustrated in FIG. 10. The alarm sample and hold circuit 46 is used in the present invention to reduce the chances of a false alarm signal 126 being transmitted by the communication circuit 36 to the system controller 14. The chances of a false alarm signal 126 being transmitted are lowered by the alarm sample and hold circuit 46 because the alarm sample and hold circuit 46 will only output an alarm condition if it has sampled two consecutive alarm conditions at the alarm output 126 of the smoke sensing circuit 20. However, an alarm sample and hold circuit 46 is not necessary to practice the present invention. The alarm signal 126 can be transmitted directly to the system controller 14 by the communication circuit 36.

In the following, the detailed operation of the alarm sample and hold circuit 46 will be described. As shown in FIG. 10, the alarm sample and hold circuit 46, which is inside the smoke sensor chip 35, comprises a first D flip-flop 134, a second D flip-flop 140, a two-input AND-gate 146, and a third D flip-flop 148. The alarm signal 126 from the smoke sensing circuit 20 is connected to the D-input 136 of the first D flip-flop 134. The Q-output 138 of the first D flip-flop 134 is connected to the D-input 142 of the second D flip-flop 140 and one of the two inputs of the AND-gate 146. The Q-output 144 of the second D flip-flop 140 is connected to the other input of the AND-gate 146. The output of the AND-gate 146 is connected to the D-input 150 of the third D flip-flop 148. The signal 256, which indicates whether an alarm condition exists, is output through the Q-output 152. The Q-output 152 of the third D flip-flop 148 is connected to pin 17, the ALARM-OUT pin, of the smoke sensor chip 35. The resets 300 of the D flip-flops 134, 140, 148 are all tied together. The clock inputs 154 of all three D flip-flops 134, 140, 148 are tied to the output of the clock selection circuit 159 which determines if a ten second clock 230 or a one second clock 232 will be used. Unless the test button 28 is actuated, the ten second clock 230 is used.

The alarm sample and hold circuit 46 samples the alarm condition signal 126 output by the smoke sensing circuit 20 every ten seconds, unless the test button 28 is depressed, in which case the sampling is every one second. When the alarm sample and hold circuit 46 outputs a LOW alarm condition signal 254, an alarm condition does not exist. When the alarm sample and hold circuit 46 outputs a HIGH alarm condition signal 254, then an alarm condition exists.

The alarm sample and hold circuit 46 operates in the same way as the low battery sample and hold circuit 40. That is, an alarm signal 126 must be present for two clock cycles for the alarm condition to be output by the AND-gate 146. Also, since the alarm sample and hold circuit 46 has a third D flip-flop 148, the output from the AND-gate 146 will be output by the third flip-flop 148, the output from the AND-gate 146 will be output by the third D flip-flop 148 on the third clock pulse.

Figure 11:
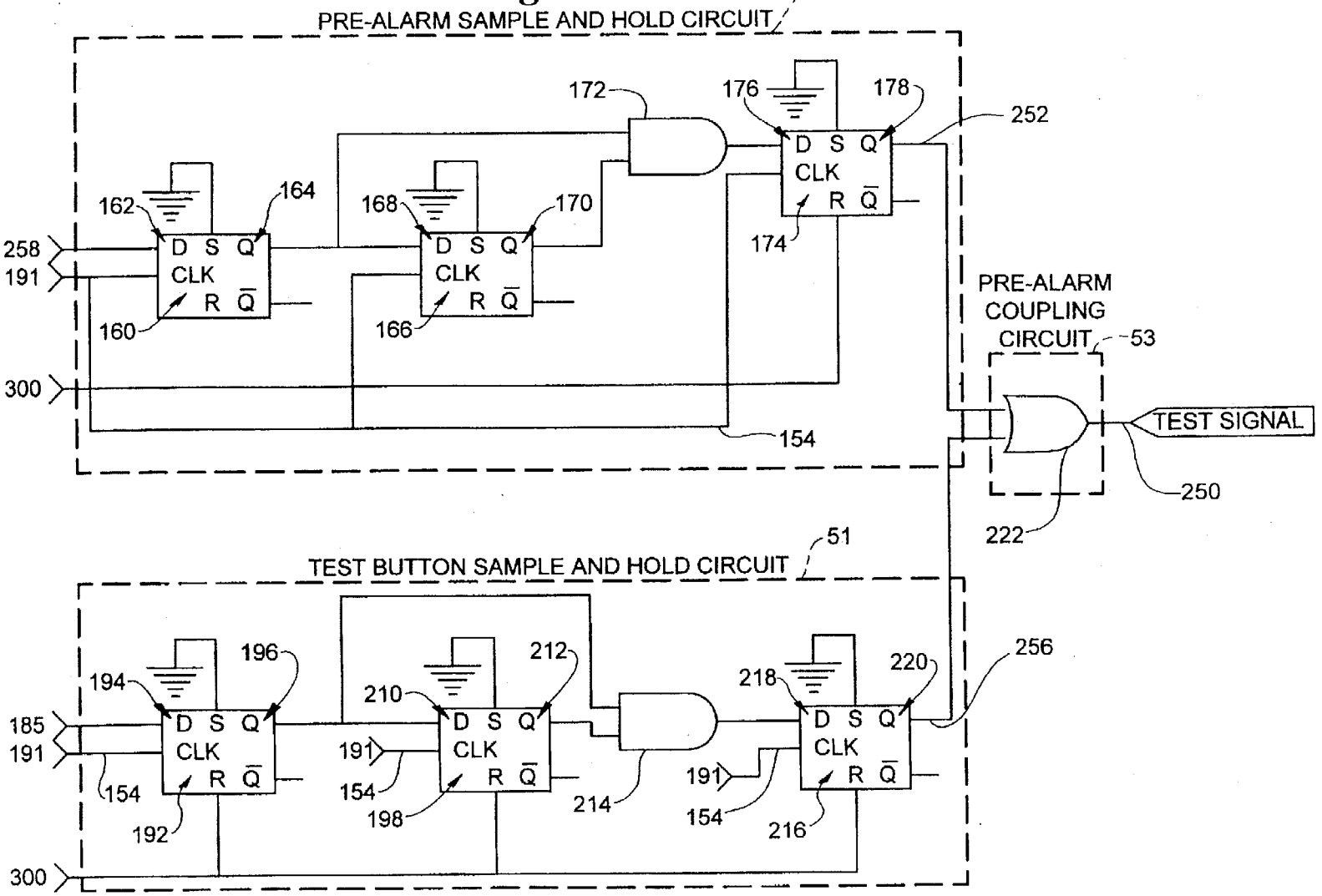
FIG. 11 illustrates the pre-alarm sample and hold circuit, the test button sample and hold circuit, and the pre-alarm coupling circuit and how these circuits interconnect.

Now, a description of the pre-alarm sample and hold circuit 48 will be provided, with reference to FIG. 11. A pre-alarm sample and hold circuit 48 is used in the present invention to reduce the chances of a false pre-alarm signal 124 being transmitted by the communication circuit 36 to the system controller 14. The chance of a false signal being transmitted is reduced because the pre-alarm sample and hold circuit 48 must sample two pre-alarm conditions consecutively for it to output a pre-alarm condition. However, a pre-alarm sample and hold circuit 48 is not necessary to practice the present invention. The output 258 from the disabling circuit 128 can be sent directly to the system controller 14 by the communication circuit 36.

In the following, the detailed operation of the pre-alarm sample and hold circuit 48 will be described. As shown in FIG. 11, the pre-alarm sample and hold circuit 48, which is in the smoke sensor chip 35, comprises a first D flip-flop 160, a second D flip-flop 166, a two input AND-gate 172, and a third D flip-flop 174. The output 258 from the disabling circuit 128 is connected to the D-input 162 of the first D flip-flop 160. The Q-output 164 of the first D flip-flop 160 is connected to the D-input 168 of the second D flip-flop 166 and to one of the two inputs of the AND-gate 172. The Q-output 170 of the second D flip-flop 166 is connected to the other input of the AND-gate 172. The output of the AND-gate 172 is connected to the D-input 176 of the third D flip-flop 174. The signal 252, which indicates whether a pre-alarm condition exists, is output through Q-output 178 of the third D flip-flop 174. All the resets 300 of the D flip-flops 160, 166, 174 are tied together. All the clock inputs 154 of the D flip-flops 160, 166, 174 are tied to the output 191 of the clock selection circuit 159.

As previously discussed in relation to the clock selection circuit 159, unless the test button 28 is actuated, the output from the disabling circuit 128 is being sampled by the pre-alarm sample and hold circuit 48 every ten seconds. When the pre-alarm sample and hold circuit 48 outputs a LOW state on line 252, a pre-alarm condition does not exist. A pre-alarm condition exists either when an alarm condition exists or when the smoke sensor 18 does detect enough smoke, dust, or other particles to trigger only a pre-alarm condition. When the pre-alarm sample and hold circuit 48 outputs a HIGH state on line 252, a pre-alarm condition exists.

However, when the smoke sensor 18 is being tested by actuation of the test button 28, since a one second clock 232 is being used, it is not necessary to use a sample and hold circuit for the alarm 126 and the pre-alarm 124 signals. The reason for the sample and hold circuits is to reduce the chances of a false condition being transmitted by the communication circuit 36. However, when the user induces the alarm condition by actuation of the test button 28, there is no reason to safeguard against a possible false condition being transmitted by the communication circuit 36.

The pre-alarm sample and hold circuit 48 operates in the same way as the low battery sample and hold circuit 40. That is, a signal 258, indicating the existence of a pre-alarm condition, output from the disabling circuit 128, must be present for two clock cycles for the pre-alarm condition to be output by the AND-gate 172. Also, since the pre-alarm sample and hold circuit 48 has a third D flip-flop 148, the output from the AND-gate 172 will be output by the third D flip-flop 174 on the third clock pulse.

Continuing to refer to FIG. 11, the test button sample and hold circuit 51 is illustrated. A test button sample and hold circuit 51 is used in the present invention to reduce the chances of transmitting to the system controller 14 a false signal indicating that the test button 28 has been actuated. The chance of a false signal is reduced because the test button sample and hold circuit 51 must sample that the test button 28 has been actuated at least two consecutive times for it to output that the test button 28 has been actuated. However, a test button sample and hold circuit 51 is not necessary to practice the present invention because the output from the test button circuit 50 can be directly transmitted to a pre-alarm coupling circuit 53.

In the following, the detailed operation of the test button sample and hold circuit 51 will be described. The test button sample and hold circuit 51 is in the smoke sensor chip 35. As shown in FIG. 11, the test button sample and hold circuit 51 comprises a first D flip-flop 192, a second D flip-flop 198, a two input AND-gate 214, and a third D flip-flop 216. The Qbar-output 185 of the D flip-flop 180 in the test button circuit 50 (FIG. 7) is connected to the D-input 194 of the first D flip-flop 192. The Q-output 196 of the first D flip-flop 192 is connected to the D-input 210 of the second D flip-flop 198 and to one of the two inputs of the AND-gate 214. The Q-output 212 of the second D flip-flop 198 is connected to an input of the AND-gate 214. The output of the AND-gate 214 is connected to the D-input of the third D flip-flop 216. The signal 256, indicating whether the test button 28 has been actuated, is output through the Q-output 22 of the third flip-flop 216. The reset 300 of the D flip-flops 192, 198, 216 are tied together. The clock inputs 154 of the D flip-flops 192, 198, 216 are tied to the output 191 of the clock selection circuit 159 (FIG. 7).

The test button sample and hold circuit 51 operates in the same way as the low battery sample and hold circuit 40. That is, an actuated test button signal 126 must be present for two consecutive clock cycles for the test button condition to be output by the AND-gate 214. Also, since the test button sample and hold circuit 51 has a third D flip-flop 216, the output from the AND-gate 214 will be output by the third D flip-flop 216 on the third clock pulse.

Continuing to refer to FIG. 11, the pre-alarm coupling circuit 53, which is inside the smoke sensor chip 35, is illustrated. The pre-alarm coupling circuit 53 determines if either a pre-alarm condition exists or an actuated test button condition exists. In the following, the detailed operation of the pre-alarm coupling circuit 53 will be described.

As shown in FIG. 11, the pre-alarm coupling circuit 53 comprises a two input OR-gate 222. The Q-output signal 252 of the pre-alarm sample and hold circuit 48 is connected to one of the inputs of the OR-gate 222. The Q-output signal 256 of the test button sample and hold circuit 51 is connected to the other input of the OR-gate 222. The OR-gate 222 outputs the test signal 250. The test signal 250 is output through pin 16, the PRE-ALARM_OUT pin, of the smoke sensor chip 35.

If either input to the OR-gate 222 is in a HIGH state, then the OR-gate 222 will output a HIGH state, resulting in a HIGH test signal 250. Thus, the pre-alarm coupling circuit 53 will output a HIGH test signal 250 if either the pre-alarm sample and hold circuit 48 outputs a HIGH pre-alarm condition or the test button sample and hold circuit 51 outputs an actuated test button condition.

FIG. 12 illustrates the operation of the test button detection control circuit 39 when the test button 28 has been actuated. The clock waveform 208 is a waveform of a one second clock 232. The other waveforms are the outputs of the test button circuit 50, the smoke sensing circuit 20, the disabling circuit 128, the alarm sample and hold circuit 51, and the pre-alarm coupling circuit 53.

Since the test button 28 has been actuated, the Qbar-output 185 will be in a HIGH state, indicating an actuated test button condition (See FIG. 7). Also, when the test button 28 is actuated, the LOW output state from the Q-output 184 is input into the gain circuit 104 to produce maximum gain (See FIG. 8). This maximum gain causes the alarm comparator 108 and the pre-alarm comparator 110 to output HIGH signals indicating the existence of a HIGH alarm signal 126 and a HIGH pre-alarm condition 124 respectively. This HIGH alarm signal 126 will be output by the Q-outputs 138, 144, and 152 in three consecutive clock cycles as long as this HIGH input state existed for two consecutive clock pulses (See FIG. 10).

The disabling circuit 128 will not output a pre-alarm condition because a HIGH alarm condition exists (See FIG. 7). The disabling circuit's output 258 will indicate that no pre-alarm condition exists. Thus, the output signal 258 from the disabling circuit 128 would be a LOW output state. The Q-outputs 164, 170, and 178 of the pre-alarm sample and hold circuit 48 would be in a LOW output state (See FIG. 11). However, the Q-outputs 196, 212, and 220 of the test button sample and hold circuit 51 would output a HIGH output state in three consecutive clock cycles, as long as the HIGH input caused by the actuation of the test button 28 existed for two consecutive clock cycles. Thus, the OR-gate 222 of the pre-alarm coupling circuit 53 would output a HIGH test signal 250. The output from the OR-gate 222 is connected to pin 16, the PRE-ALARM_OUT pin, of the smoke sensor chip 35.

As shown in FIG. **4*e*, the communication circuit 36 receives the output from the pre-alarm coupling circuit 53 through pin 16, the PRE-ALARM_OUT pin, of the smoke sensor chip 35. The signal from the PRE-ALARM_OUT pin is input into the transmitter chip 78 which then transmits the signal to the system controller 14**.

Similarly, the HIGH output from the Q-output 152 of the alarm sample and hold circuit 46 will be output from the smoke sensor chip 35 through pin 17, the ALARM_OUT pin is connected to the communication circuit 36 which transmits the signal to the system controller 14.

In operation, the system controller 14 receives outputs from both the alarm sample and hold circuit 46 and the pre-alarm coupling circuit 53. When the test button 28 is actuated, the system controller 14 will receive a HIGH sampled alarm signal 254 and a HIGH test signal 250. Upon receiving both HIGH signals, the system controller 14 determines that the alarm condition was caused by the actuation of the test button 28. As stated earlier, when an alarm condition or a pre-alarm condition is caused by smoke or dust, the system controller 14 only receives one HIGH signal. Thus, the system controller 14 is able to distinguish between an alarm condition caused by the actuation of a test button 28 and one caused by the detection of smoke.

While preferred embodiments of the present invention have been described, it should be appreciated that various modifications may be made by those skilled in the art without departing from the spirit and scope of the present invention. Accordingly, reference should be made to the claims to determine the scope of the present invention.

What is claimed is:

1. In a security system comprising (i) a sensor having a testing feature and a means for actuating and performing a test of the sensor, the test causing the sensor to generate an alarm signal when the sensor is working properly, and (ii) a remote monitoring station operably connected to the sensor and located remotely from a premises where the sensor is located, wherein alarm conditions are automatically reported to the remote monitoring station, a method for testing the sensor with the security system in a normal operating mode, the method comprising:

(a) actuating a test of the sensor by the sensor's test actuating means, thereby generating an alarm signal when the sensor is working properly;

(b) generating, in response to the actuation of the test, a signal indicating that a test has been actuated; and (c) preventing, when both an alarm signal and a test signal are generated, the reporting of an alarm condition to the remote monitoring station.

2. The method of claim 1, further comprising forwarding the results of the test to the remote monitoring station in a form wherein the remote monitoring station recognizes the results to be test information and not alarm information.

3. The method of claim 1 wherein the sensor is a smoke detector.

4. In a security system comprising (i) a sensor having a testing feature and a means for actuating and performing a test of the sensor, the test causing the sensor to generate an alarm signal when the sensor is working properly, (ii) a control panel operably connected to the sensor and located at a premises where the sensor is located, the control panel for receiving and processing signals transmitted to it from sensors, and (iii) a remote monitoring station operably connected to the control panel and located remotely from the premises where the sensor and the control panel are located, wherein alarm conditions are automatically reported to the remote monitoring station, a method for testing the sensor with the security system in a normal operating mode, the method comprising:

(a) actuating a test of the sensor by the sensor's test actuating means, thereby generating an alarm signal when the sensor is working properly, and transmitting an indication that the alarm signal has been generated to the control panel;

(b) generating, in response to the actuation of the test, a signal indicating that a test has been actuated and transmitting an indication that the test signal has been generated to the control panel; and (c) preventing, when the control panel receives from the sensor a signal indicating that both an alarm signal and a test signal have been generated, the reporting of an alarm condition from the control panel to the remote monitoring station.

5. The method of claim 4, further comprising forwarding the results of the test from the control panel to the remote monitoring station in a form wherein the remote monitoring station recognizes the results to be test information and not alarm information.

6. The method of claim 4 wherein the sensor is a smoke detector.

7. In a security system comprising (i) a sensor having a testing feature and a means for actuating and performing a test of the sensor, the test causing the sensor to generate an alarm signal when the sensor is working properly, (ii) a control panel operably connected to the sensor and located at a premises where the sensor is located, the control panel for receiving and processing signals transmitted to it from sensors, and (iii) a remote monitoring station operably connected to the control panel and located remotely from a premises where the sensor and the control panel are located, wherein alarm conditions are automatically reported to the remote monitoring station an apparatus for testing the sensor with the security system in a normal operating mode, the apparatus comprising:

(a) means, responsive to the actuation of a test, for generating a signal indicating that a test has been actuated; and (b) means for preventing, when both an alarm signal and a test signal have been generated, the reporting of an alarm condition to the remote monitoring station.

8. The apparatus of claim 7 wherein the sensor is a smoke detector.

9. The apparatus of claim 8 wherein:

(a) the test signal generating means is contained on the sensor; and (b) the forwarding prevention means is contained in the control panel.

10. The apparatus of claim 9, further comprising a means, responsive to the sensor test feature and the test signal generating means, for forwarding the results of the test from the control panel to the remote monitoring station in a form wherein the remote monitoring station recognizes the results to be test information and not alarm information.

11. A sensor comprising:

means for detecting an alarm condition, wherein a signal indicative of an alarm is generated when the alarm condition is detected;

means for actuating and performing a test of the sensor, wherein the signal indicative of an alarm condition is generated when the test is performed and the sensor is working properly; and a transmitter, responsive to signals indicative of an alarm, for forwarding, from the sensor to a processor located remotely from the sensor, a signal comprising information sufficient to allow the processor to determine whether the alarm signal was caused by the detection of the alarm condition or by the performance of a test.

12. The sensor of claim 11 wherein the processor is a security system control panel located at a premises at which the sensor is located.

13. The sensor of claim 12 wherein, when the security system control panel receives, from the sensor, a signal comprising information indicating that an alarm signal was generated and that the alarm signal was generated by the performance of a test, the security system control panel does not transmit an alarm signal to a monitoring station located remotely from the premises where the sensor and the control panel are located.

14. The sensor of claim 11 further comprising:

means for detecting a pre-alarm condition, the pre-alarm condition existing at least if the alarm condition exists, wherein a signal indicative of a pre-alarm is generated when the pre-alarm condition is detected or when a test is performed;

means for disabling the pre-alarm signal when an alarm signal is generated by the detection of the alarm condition and not by a test of the sensor, so that, when an alarm signal is generated, the pre-alarm signal serves to distinguish whether the alarm signal was caused by the detection of the alarm condition or by the performance of a test.

15. The sensor of claim 11 wherein:

the detecting means is a smoke sensing circuit; and the alarm condition is smoke in at least a predetermined amount.

16. The sensor of claim 14 wherein:

the means for detecting the alarm condition and the means for detecting the pre-alarm condition comprise a smoke sensing chamber;

the pre-alarm condition is smoke in at least a first predetermined amount; and the alarm condition is smoke in at least a second predetermined amount, the second predetermined amount being greater than the first predetermined amount.

17. The sensor of claim 16 wherein the pre-alarm condition may also be sensor blocking particles in at least a predetermined amount collected on the smoke sensing chamber.

18. The sensor of claim 17 wherein the sensor blocking particles are dust.

19. The sensor of claim 11 wherein the test is whether the sensor is in a condition that is sufficient to detect and give notice of the existence of an alarm condition.

* * * * *